US012723320B2

(12) United States Patent
Su et al.

(10) Patent No.: US 12,723,320 B2
(45) Date of Patent: Sep. 1, 2026

(54) METHOD FOR PREPARING ANODIC ALUMINUM OXIDE-BASED PHOTONIC CRYSTAL PRODUCT AND ANODIC ALUMINUM OXIDE-BASED PHOTONIC CRYSTAL PRODUCT PREPARED THEREBY

(71) Applicant: Jabil Circuit (Singapore) Pte. Ltd., Singapore (SG)

(72) Inventors: Yi-Chung Su, Taichung City (TW); Pen-Yi Liao, Taichung City (TW); Chih-Hao Chen, Taichung City (TW); Kuan-Yu Su, Taichung City (TW); Fu-Pin Tang, Taichung City (TW); Mei-Chun Chen, Taichung City (TW)

(73) Assignee: Jabil Circuit (Singapore) Pte. Ltd., Singapore (SG)

( * ) Notice: Subject to any disclaimer, the term of this patent is extended or adjusted under 35 U.S.C. 154(b) by 7 days.

(21) Appl. No.: 18/947,459

(22) Filed: Nov. 14, 2024

(65) Prior Publication Data

US 2025/0230570 A1 Jul. 17, 2025

(30) Foreign Application Priority Data

Jan. 12, 2024 (CN) ..... 202410054942.1

(51) Int. Cl.
*C25D 11/12* (2006.01)
*C25D 11/16* (2006.01)
*C25D 21/12* (2006.01)

(52) U.S. Cl.
CPC ..... *C25D 11/12* (2013.01); *C25D 11/16* (2013.01); *C25D 21/12* (2013.01)

(58) Field of Classification Search
None
See application file for complete search history.

(56) References Cited

U.S. PATENT DOCUMENTS 11,060,177 B2 7/2021 Zhou et al.

FOREIGN PATENT DOCUMENTS

CN 101520525 A 9/2009
CN 102560650 A 7/2012
(Continued)

OTHER PUBLICATIONS

Acosta et al. (APL Photon. 7, 026108 '2022'). (Year: 2022).*
(Continued)

*Primary Examiner* — Wojciech Haske
(74) *Attorney, Agent, or Firm* — Young Basile Hanlon & MacFarlane. P.C.

(57) ABSTRACT

A method for preparing an anodic aluminum oxide-based photonic crystal product includes: subjecting an aluminum-containing object to a first pretreatment; subjecting the aluminum-containing object to a first anodizing treatment by applying periodic current signals, so as to form first porous aluminum oxide films on the aluminum-containing object along a first direction, the first porous aluminum oxide films each including first nanopore structures; and subjecting the aluminum-containing object to a second anodizing treatment by applying a slowly increasing current signal, followed by constant current signal so as to form a second porous aluminum oxide film beneath an $N^{th}$ first porous aluminum oxide film, the second porous aluminum oxide film including second nanopore structures. An anodic aluminum oxide-based photonic crystal product prepared by the method is also provided.

7 Claims, 17 Drawing Sheets
(5 of 17 Drawing Sheet(s) Filed in Color)

(56) References Cited

FOREIGN PATENT DOCUMENTS

| | | | |
|---|---|---|---|
| CN | 102644112 | A | 8/2012 |
| CN | 103243368 | A | 8/2013 |
| CN | 114351236 | B | 5/2023 |
| TW | 201107534 | A | 3/2011 |

OTHER PUBLICATIONS

Shang et al. (Scientific Reports, '2014' 4 : 3601). (Year: 2014).*
Wei et al. (Optical Materials 122 '2021' 111722) (Year: 2021).*
Abd-Elnaiem et al. (Recent Progress in the Fabrication of Photonic Crystals Based on Porous Anodic Materials. Energies 2023, 16, 4032) (Year: 2023).*
Law et al. (Nanomaterials 2018, 8, 788) (Year: 2018).*
Law et al. (ACS Appl. Mater. Interfaces 2016, 8, 13542-13554) (Year: 2016).*
Kushnir et al. (Materials and Design 144 '2018' 140-150) (Year: 2018).*
Search Report appended to an Office Action, which was issued to Taiwanese counterpart application No. 113102096 by the TIPO on Oct. 4, 2024, with an English translation thereof.

* cited by examiner

METHOD FOR PREPARING ANODIC ALUMINUM OXIDE-BASED PHOTONIC CRYSTAL PRODUCT AND ANODIC ALUMINUM OXIDE-BASED PHOTONIC CRYSTAL PRODUCT PREPARED THEREBY

CROSS-REFERENCE TO RELATED APPLICATION

This application claims priority to Chinese Invention patent application No. 202410054942.1, filed on Jan. 12, 2024, the entire disclosure of which is incorporated by reference herein.

FIELD

The present disclosure relates to a method for preparing an anodic aluminum-based photonic crystal product, and more particularly to a method for preparing an anodic aluminum-based photonic crystal product with enhanced color saturation and brightness properties. The present disclosure also relates to an anodic aluminum-based photonic crystal product prepared by the method.

BACKGROUND

Photonic crystals, which were first discovered by Sajeev John and Eli Yablonovitch in 1987, have been successively used in various technical fields. In comparison with conventional chemical coloring technique, use of photonic crystals for adjusting color has advantageous characteristics, e.g., simple procedures, environmentally friendly without pollution, etc., and thus is widely recommended by the industry in recent years.

CN 103243368 A discloses a method for preparing a two-dimensional photonic crystal structure with full-spectrum color control which includes the steps of: (i) cleaning an aluminum sheet; (ii) subjecting the aluminum sheet obtained after step (i) to electrochemical polishing; (iii) subjecting the aluminum sheet obtained after step (ii) to an anodizing treatment conducted using 0.3 M oxalic acid solution at a voltage of 50 V for 12 hours so as to form a first aluminum oxide film on a surface of the aluminum sheet; (iv) subjecting the first aluminum oxide film on the surface of the aluminum sheet obtained after step (iii) to a wet etching process conducted using an etchant formed by mixing chromic acid and phosphoric acid; (v) subjecting the aluminum sheet obtained after step (iv) to another anodizing treatment conducted using the oxalic acid solution for 48 seconds so as to form a second aluminum oxide film on a surface of the first aluminum oxide film; (vi) subjecting the second aluminum oxide film to another wet etching process conducted using the etchant for a time period ranging from 0.3 hours to 1.5 hours; (vii), repeating the aforesaid steps (v) and (vi) sequentially 5 times; and (viii) subjecting the aluminum sheet obtained after step (vii) to magnetron sputtering process so as to form a highly reflective coating on the aluminum sheet.

Although color adjustment can be achieved by the method of CN 103243368 A, the method of such patent document still requires the magnetron sputtering process of step (viii) to be conducted in order to accomplish color display, and the color saturation and brightness of the displayed colors are relatively limited. In addition, since the wet etching process and the anodizing treatment are required to be repeatedly conducted, the method of CN 103243368 is also relatively cumbersome.

In view of the above, development of a novel method for preparing photonic crystal products to improve color saturation and brightness of products obtained by such method is an aim to be achieved by those skilled in the art.

SUMMARY

Therefore, an object of the present disclosure is to provide an anodic aluminum oxide-based photonic crystal product and methods for preparing an anodic aluminum oxide-based photonic crystal product that can alleviate at least one of the drawbacks of the prior art.

According to an aspect of the present disclosure, the method includes the steps of:

(a) subjecting an aluminum-containing object to a first pretreatment, so as to remove contaminants on a surface of the aluminum-containing object;

(b) subjecting the aluminum-containing object obtained after step (a) to a first anodizing treatment, so as to form an N number of first porous aluminum oxide films that are sequentially stacked on the surface of the aluminum-containing object along a first direction, the first direction being defined as a direction from a topmost one of the first porous aluminum oxide films, which is distal from the aluminum-containing object, to a bottommost one of the first porous aluminum oxide films, which is proximal to the aluminum-containing object, each of the first porous aluminum oxide films including a plurality of first nanopore structures which extend along the first direction and which are spaced apart from one another along a second direction that is perpendicular to the first direction; and (c) subjecting the aluminum-containing object obtained after step (b) to a second anodizing treatment, so as to form a second porous aluminum oxide film on the surface of the aluminum-containing object and beneath an $N^{th}$ first porous aluminum oxide film among the N number of first porous aluminum oxide films in the first direction, the second porous aluminum oxide film including a plurality of second nanopore structures which extend along the first direction and which are spaced apart from one another along the second direction. In step (b), the first anodizing treatment is performed by applying N cycles of periodic current signals to the aluminum-containing object obtained after step (a). In step (c), the second anodizing treatment is performed by applying a slowly increasing current signal, from 0 mA to a predetermined current value, to the aluminum-containing object obtained after step (b) for a first predetermined time period, followed by applying a constant current signal having the predetermined current value to the aluminum-containing object for a second predetermined time period. The predetermined current value is greater than a maximum current value of each of the N cycles of the periodic current signals of the first anodizing treatment.

According to another aspect of the present disclosure, the method includes the steps of:

(a) subjecting an aluminum-containing object to a first pretreatment, so as to remove contaminants on a surface of the aluminum-containing object;

(b) subjecting the aluminum-containing object obtained after step (a) to a first anodizing treatment, in which a plurality of cycles of periodic current signals are applied to the aluminum-containing object, so as to form a plurality of first porous aluminum oxide films that are sequentially stacked on the surface of the aluminum-containing object, each of the plurality of first porous aluminum oxide films including a plurality of first nanopore structures; and (c) subjecting the aluminum-containing object obtained after step (b) to a second anodizing treatment, so as to form a second porous aluminum oxide film on the surface of the aluminum-containing object and beneath a bottommost one of the first porous aluminum oxide films which is proximal to the aluminum-containing object among the plurality of first porous aluminum oxide films, the second porous aluminum oxide film including a plurality of second nanopore structures. In step (c), the second anodizing treatment is performed by applying a slowly increasing current signal, from 0 mA to a predetermined current value, to the aluminum-containing object obtained after step (b) for a first predetermined time period, followed by applying a constant current signal having the predetermined current value to the aluminum-containing object for a second predetermined time period. The predetermined current value is greater than a maximum current value of each of the plurality of cycles of periodic current signals of the first anodizing treatment.

According to yet another aspect of the present disclosure, the anodic aluminum oxide-based photonic crystal product includes:

an aluminum-containing object;

an N number of first porous aluminum oxide films that are sequentially stacked on a surface of the aluminum-containing object along a first direction, the first direction being defined as a direction from a topmost one of the first porous aluminum oxide films, which is distal from the aluminum-containing object, to a bottommost one of the first porous aluminum oxide films, which is proximal to the aluminum-containing object, each of the first porous aluminum oxide films including a plurality of first nanopore structures which extend along the first direction and which are spaced apart from one another along a second direction that is perpendicular to the first direction; and a second porous aluminum oxide film formed on the surface of the aluminum-containing object and beneath an $N^{th}$ first porous aluminum oxide film among the N number of first porous aluminum oxide films in the first direction, the second porous aluminum oxide film including a plurality of second nanopore structures which extend along the first direction and which are spaced apart from one another along the second direction. Each of the plurality of second nanopore structures has a cross-section of a tubular shape in the first direction, includes an upper porous section and a lower porous section. The upper porous section is distal from the aluminum-containing object, widens at a top part, and is in spatial communication with a corresponding one of the plurality of the first nanopore structures of the $N^{th}$ first porous aluminum oxide film. The lower porous section is proximal to the aluminum-containing object and is in spatial communication with the upper porous section and the surface of the aluminum-containing object. A thickness the second porous aluminum oxide film, which is measured from a top end to a bottom end along the first direction, is greater than a total thickness of the plurality of the first porous aluminum oxide films.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Other features and advantages of the present disclosure will become apparent in the following detailed description of the embodiment(s) with reference to the accompanying drawings. It is noted that various features may not be drawn to scale.

DETAILED DESCRIPTION

Figure 1:
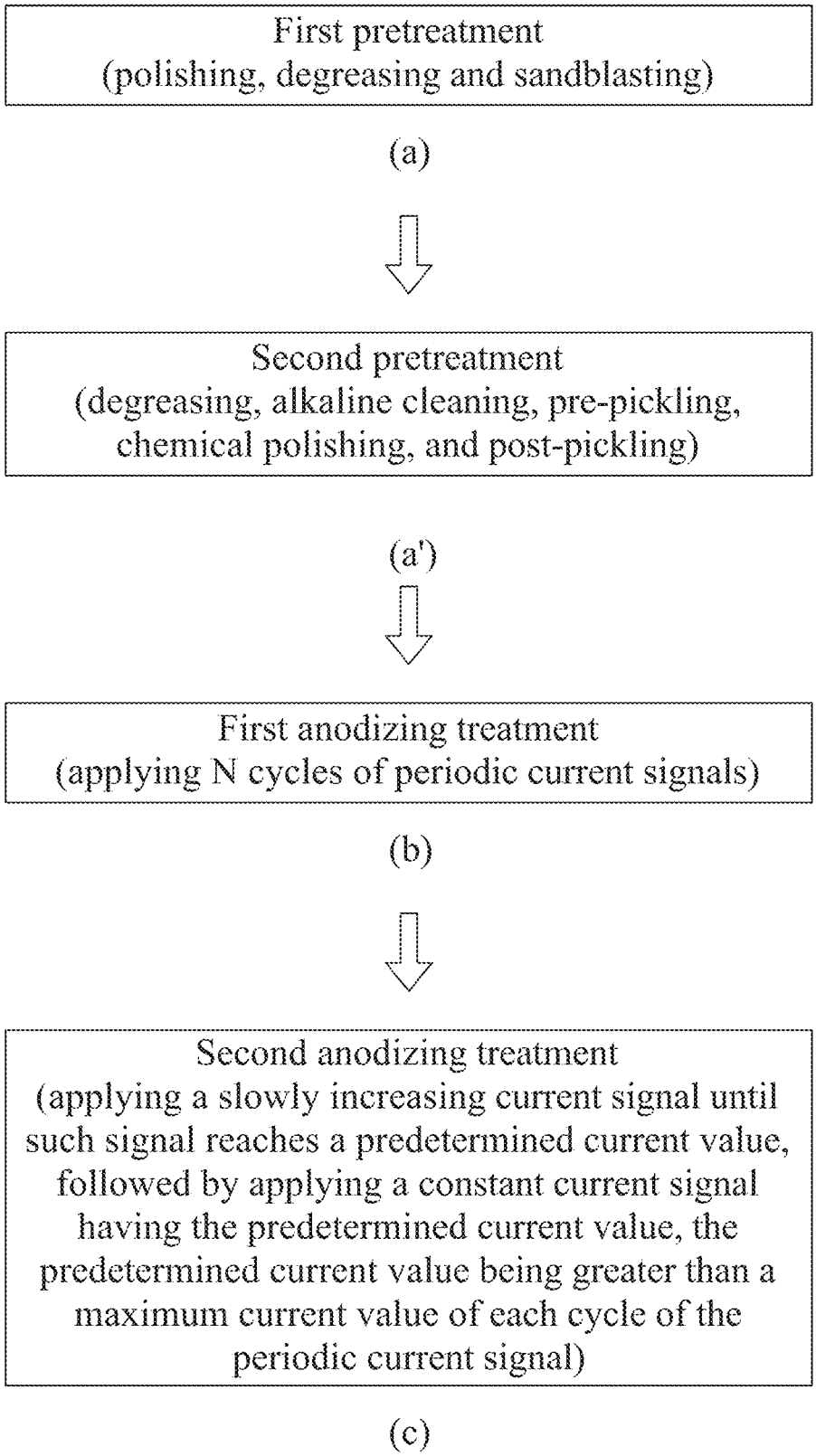
FIG. 1 is a flow diagram illustrating a method for preparing an anodic aluminum oxide-based photonic crystal product according to a first embodiment of the present disclosure.

Before the present disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Referring to FIG. 1, a method for preparing an aluminum oxide-based photonic crystal product 1 according to a first embodiment of the present disclosure includes the following steps (a), (a'), (b) and (c).

Figure 3:
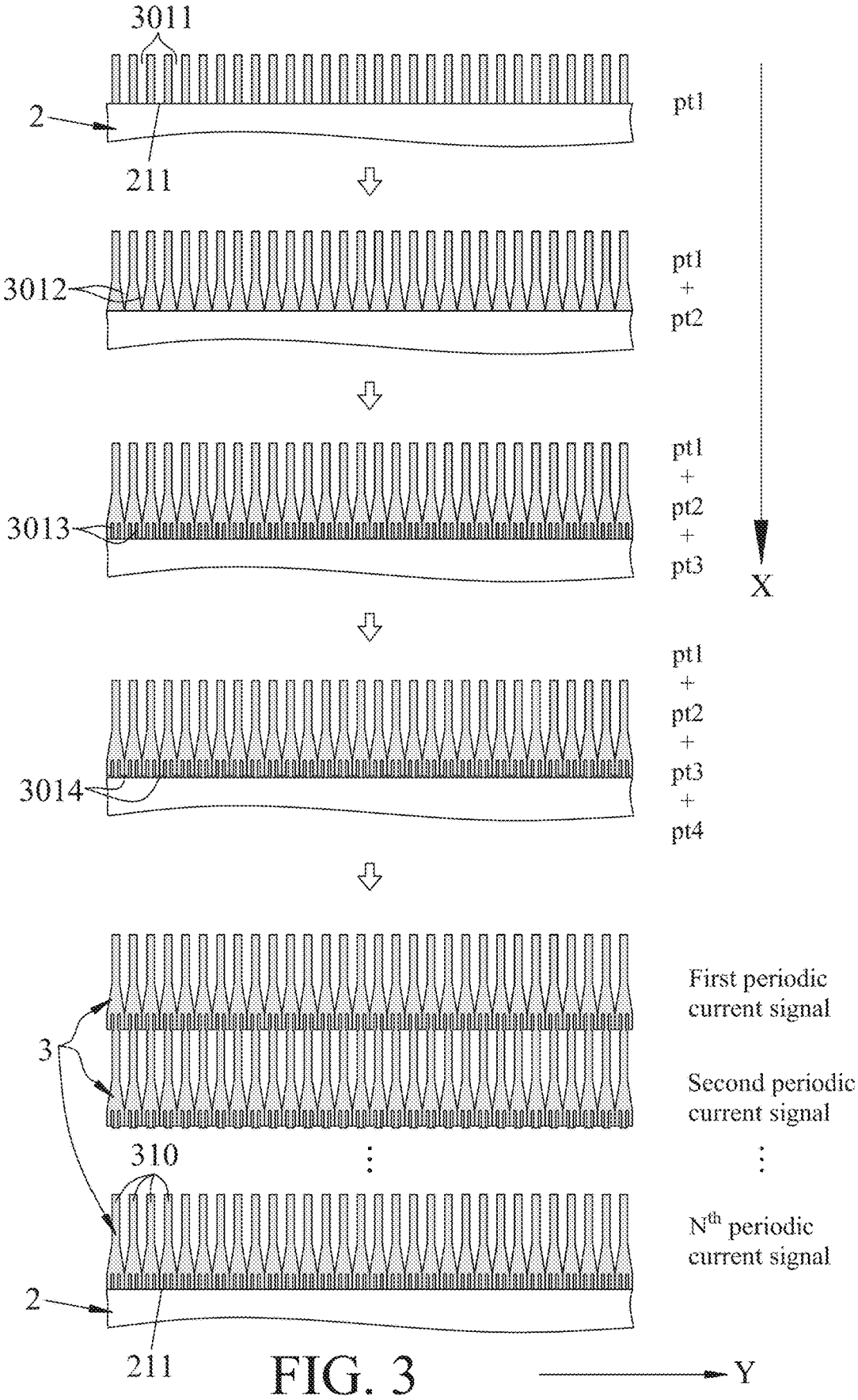
FIG. 3 is a schematic diagram of processes for preparing the anodic aluminum oxide-based photonic crystal product, illustrating that N number of first porous aluminum oxide films are obtained after applying N cycles of periodic current signals in step (b) of the method according to the first embodiment of the present disclosure.

In step (a), an aluminum-containing object 2, as shown in FIG. 3, is subjected to a first pretreatment, so as to remove contaminants (not shown) on a surface 211 of the aluminum-containing object 2. In the first embodiment, the first pretreatment includes degreasing and sandblasting conducted in sequence.

In step (a'), the aluminum-containing object 2 obtained after sandblasting of step (a) is subjected to a second pretreatment which includes degreasing, alkaline cleaning, pre-pickling, chemical polishing, and post-pickling conducted in sequence.

Figure 4:
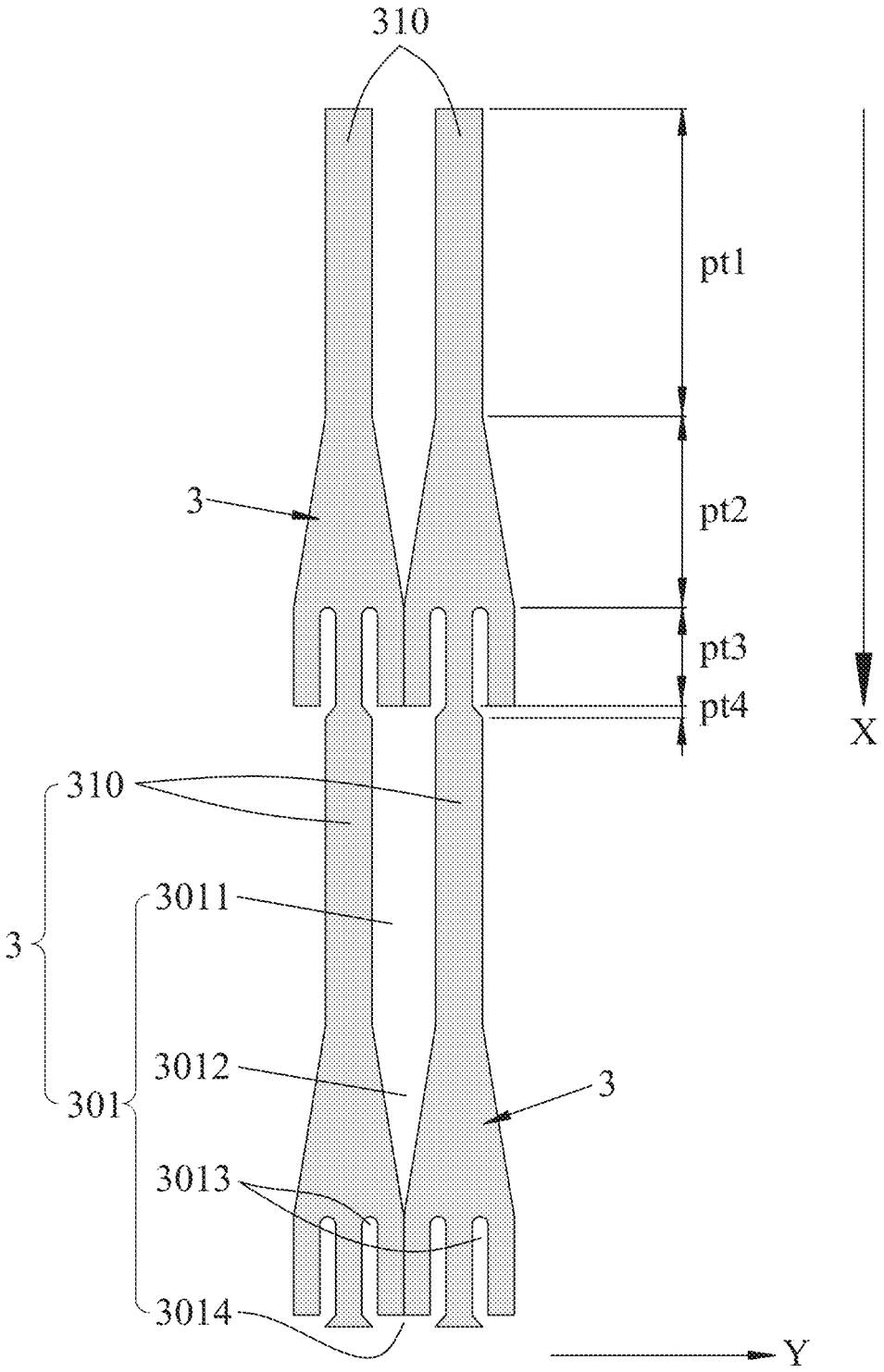
FIG. 4 is a partially enlarged schematic view illustrating arrangement of first aluminum oxide bodies which define first nanopore structures in the first porous aluminum oxide films shown in FIG. 3.

In step (b), the aluminum-containing object 2 obtained after step (a') is subjected to a first anodizing treatment by immersing such aluminum-containing object 2 in a first electrolyte solution (not shown in figures), followed by applying N cycles of periodic current signals, so as form an N number of first porous aluminum oxide films 3 that are sequentially stacked on the surface 211 of the aluminum-containing object 2 along a first direction (X). As shown in FIGS. 3 and 4, the first direction (X) is defined as a direction from a topmost one of the first porous aluminum oxide films 3, which is distal from the aluminum-containing object 2, to a bottommost one of the first porous aluminum oxide films 3, i.e., an $N^{th}$ first porous aluminum oxide film 3, which is proximal to the aluminum-containing object 2. Each of the first porous aluminum oxide films 3 includes a plurality of first nanopore structures 301 which extend along the first direction (X) and which are spaced apart from one another along a second direction (Y) that is perpendicular to the first direction (X). Each of the first porous aluminum oxide films 3 further includes a plurality of first aluminum oxide bodies (310) which are arranged adjacent and parallel to one another along the second direction (Y), so as to define the first nanopore structures 301. It should be noted that, as shown in FIGS. 3 and 4, the first aluminum oxide bodies 310 of a respective one of the first porous aluminum oxide films 3 extend along the first direction (X) to be respectively connected to corresponding ones of the first aluminum oxide bodies 310 of adjacent ones of the first porous aluminum oxide films 3.

Figure 2:
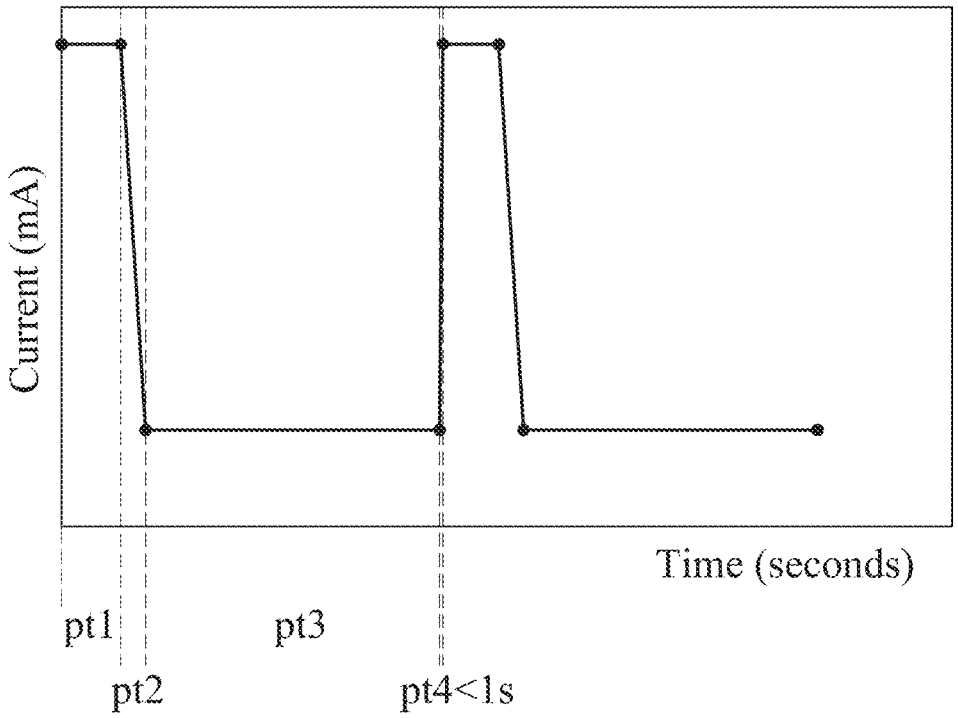
FIG. 2 is a graph of current versus time illustrating application of a first periodic current signal in a first anodizing treatment of step (b) of the method according to the first embodiment of the present disclosure.

To be specific, as shown in FIG. 2, each of the N cycles of the periodic current signals applied in step (b) sequentially includes a first predetermined time period pt1, a second predetermined time period pt2, a third predetermined time period pt3, and a fourth predetermined time period pt4. During the first predetermined time period pt1, a first constant current signal having a first current value is applied to the aluminum-containing object 2 obtained after step (a'). During the second predetermined time period pt2, i.e., after the first predetermined time period pt1, a decreasing current signal, which has the first current value that gradually decreases to a second current value, is applied to the aluminum-containing object 2. During the third predetermined time period pt3, i.e., after the second predetermined time period pt2, a second constant current signal having the second current value is applied to the aluminum-containing object 2. During the fourth predetermined time period pt4, i.e., after the third predetermined time period pt3, a rapidly increasing current signal, which has the second current value that rapidly increases to the first current value, is applied to aluminum-containing object 2. It should be noted that, in an $N^{th}$ cycle of the periodic current signals, the second constant current signal having the second current value is directly cut off after the third predetermined time period pt3, i.e., the rapidly increasing current signal having the second current value is not applied to the aluminum-containing object 2.

In detail, the first porous aluminum oxide films 3 obtained after the first anodizing treatment in step (b) of the method of first embodiment are shown in FIGS. 3 and 4. Each of the first nanopore structures 301 of a respective one of the first porous aluminum oxide films 3 includes a first porous section 3011, a second porous section 3012, a plurality of third porous sections 3013, and a fourth porous section 3014 along the first direction (X). The first porous section (3011) of each of the first nanopore structures 301 is defined by upper side portions of two adjacent ones of the first aluminum oxide bodies 310, and has a cross-section of a rectangular shape along the first direction (X). The second porous section 3012 of each of the plurality of first nanopore structures 301 is defined by middle side portions of the two adjacent ones of the first aluminum oxide bodies 310, gradually tapers downwardly to form a pointed end such that the second porous section 3012 has a cross-section of an inverted triangular shape along the first direction (X), and is in spatial communication with the first porous section 3011. The third porous sections 3013 of each of the first nanopore structures 301 are each defined by a lower portion of a corresponding one of the first aluminum oxide bodies 310, are spaced apart from one another along the second direction (Y), each extends downwardly to have a cross-section of a tubular shape along the first direction (X), have a size smaller than a size of the first porous section 3011, and are not in spatial communication with the second porous section 3012. The fourth porous section 3014 of each of the first nanopore structures 301 is defined by bottom side end portions of the two adjacent ones of the first aluminum oxide bodies 310, rapidly widens at a top part along the first direction (X), and is in spatial communication with corresponding ones of the third porous section 3013.

It should be noted that, the first nanopore structures 301 in a respective one of the first porous aluminum oxide films 3 are defined by corresponding ones of the first aluminum oxide bodies (310) in the first anodizing treatment of step (b) when a respective one of the N cycles of periodic current signals is applied to the aluminum-containing object 2 obtained after step (a'). Therefore, the first porous section 3011, the second porous section 3012, the plurality of the third porous sections 3013 and the fourth porous section 3014 of each of the first nanopore structures 301 defined by corresponding ones of the first aluminum oxide bodies (310) respectively correspond to the first predetermined time period pt1, the second predetermined time period pt2, the third predetermined time period pt3 and the fourth predetermined time period pt4 of the respective one of the N cycles of periodic current signals.

Referring again to FIGS. 2 and 3, since the first constant current signal having the first current value is applied during the first predetermined time period pt1 of the respective one of the N cycles of periodic current signals in step (b), the first porous section 3011 of each of the first nanopore structures 301, which is defined by upper side portions of two adjacent ones of the first aluminum oxide bodies 310, has a cross-section of a rectangular shape along the first direction (X).

Since the decreasing current signal having the first current value that gradually decreases to a second current value is applied during the second predetermined time period pt2 of the respective one of the N cycles of periodic current signals in step (b), the second porous section 3012 of each of the first nanopore structures 301, which is defined by middle side portions of the two adjacent ones of the first aluminum oxide bodies 310, gradually tapers downwardly to form a pointed end, such that the second porous section 3012 has a cross-section of an inverted triangular shape along the first direction (X), and is in spatial communication with the first porous section 3011.

Since the second constant current signal having the second current value is applied during the third predetermined time period pt3 of the respective one of the N cycles of periodic current signals in step (b), the third porous sections 3013 of each of the first nanopore structures 301 are each defined by a lower portion of a corresponding one of the first aluminum oxide bodies 310, are spaced apart from one another along the second direction (Y), each extends downwardly to have a cross-section of a tubular shape along the first direction (X), have a size smaller than a size of the first porous section 3011, and are not in spatial communication with the second porous section 3012.

Since the rapidly increasing current signal having the second current value that rapidly increases to the first current value is applied during the second predetermined time period pt2 of the respective one of the N cycles of periodic current signals in step (b), the second fourth section 3014 of each of the first nanopore structures 301, which is defined by bottom side end portions of the two adjacent ones of the first aluminum oxide bodies 310, rapidly widens at a top part along the first direction (X), and is in spatial communication with corresponding ones of the third porous sections 3013.

As shown in FIGS. 3 and 4, for the each of the first nanopore structures 301 in a respective one of the first porous aluminum oxide film 3, the first porous section 3011 is in spatial communication with the fourth porous section 3014 of an adjacent one of the first nanopore structures 301 of a corresponding adjacent one of the first porous aluminum oxide films 3 which is distal to the aluminum-containing object 2 along the first direction (X), and the fourth porous section 3014 is in spatial communication with corresponding ones of the third porous sections 3013 and also with the first porous section 3011 of another adjacent one of the first nanopore structures 301 of a corresponding adjacent one of the first porous aluminum oxide films 3 which is proximal to the aluminum-containing object 2 along the first direction (X). After completion of the first anodizing treatment of step (b), the first aluminum oxide bodies 310 and corresponding ones of the first nanopore structures 301 of a corresponding one of the first porous aluminum oxide films 3 obtained after application of first cycle of the N cycles of the periodic current signals are farthest from the surface 211 of the aluminum-containing object 2 among all of the first porous aluminum oxide films 3, while the first aluminum oxide bodies 310 and corresponding ones of the first nanopore structures 301 of the $N^{th}$ first porous aluminum oxide film 3 obtained after application of the $N^{th}$ cycle of the periodic current signals, i.e., last cycle of the N cycles of periodic current signals, are directly in contact with the surface 211 of the aluminum-containing object 2.

Since the second constant current signal having the second current value applied to the aluminum-containing object 2 is directly cut off after the third predetermined time period pt3 in the $N^{th}$ cycle of the periodic current signals, the fourth porous section 3014 is absent from (i.e., not defined) each of the first nanopore structures 301 of the $N^{th}$ first porous aluminum oxide films 3 obtained after application of the $N^{th}$ cycle of the periodic current signals.

It is worth to mention that, since the decreasing current signal is applied during the second predetermined time period pt2 of the respective one of the N cycles of periodic current signals in step (b) of the method of the first embodiment, each of the first aluminum oxide bodies 310 in the respective one of the first aluminum oxide films has two opposite inclined sides at middle portion thereof, such that the middle side portions of the two adjacent ones of the first aluminum oxide bodies 310 define the second porous section 3012 of each of the first nanopore structures 301, thereby allowing the first porous aluminum oxide films 3 to exhibit different colors at different viewing angles.

Figure 5:
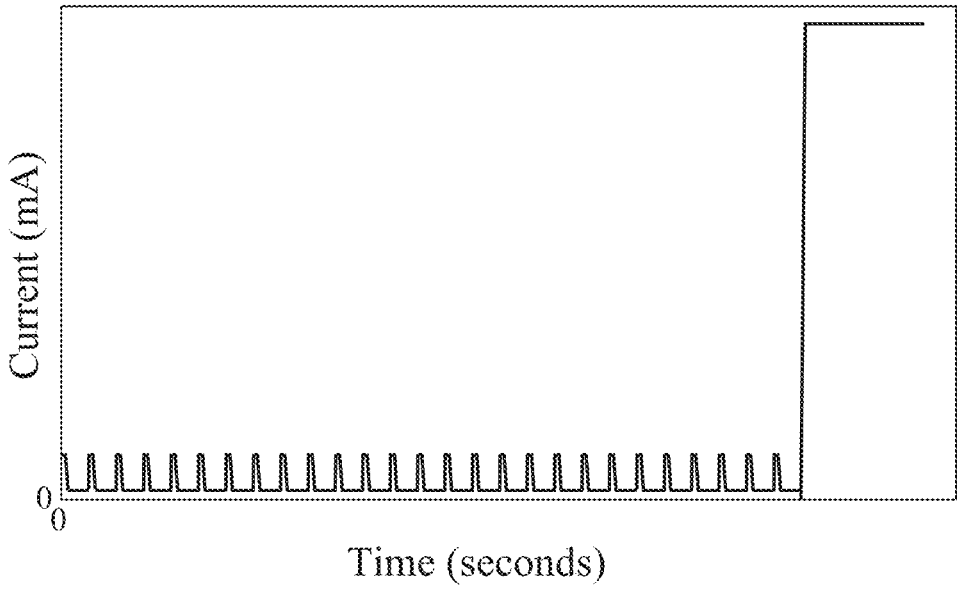
FIG. 5 is a graph of current versus time illustrating application of N cycles of periodic current signals in the first anodizing treatment of step (b) followed by a current signal in a second anodizing treatment of step (c) of the method according to the first embodiment of the present disclosure.
Figure 6:
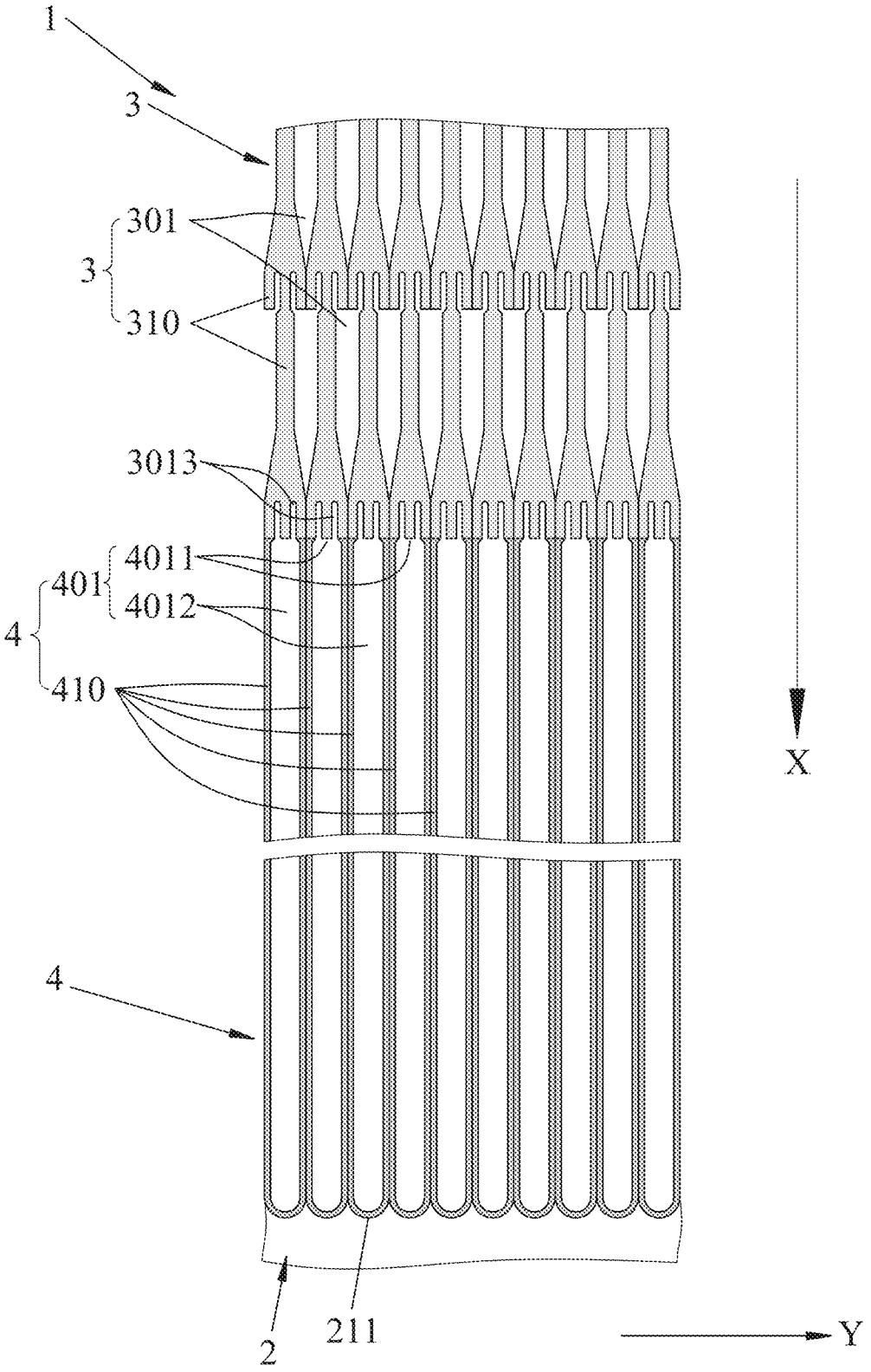
FIG. 6 is a fragmentary schematic view illustrating the anodic aluminum oxide-based photonic crystal product obtained after step (c) of the method according to the first embodiment of the present disclosure.

Referring to FIGS. 5 and 6, in step (c), the aluminum-containing object 2 is subjected to a second anodizing treatment by immersing such aluminum-containing object 2 in a second electrolyte solution 62 (see FIG. 7) that is different from the first electrolyte solution, so as to form a second porous aluminum oxide film 4 on the surface 211 of the aluminum-containing object 2 and beneath an $N^{th}$ first porous aluminum oxide film 3 among the N number of the first porous aluminum oxide films 3 in the first direction (X). The second porous aluminum oxide film 4 includes a plurality of second nanopore structures 401 which extend along the first direction (X) and which are spaced apart from one another along the second direction (Y). The second porous aluminum oxide film 4 further includes a plurality of second aluminum oxide bodies 410 which are arranged adjacent and parallel to one another along the second direction (Y), so as to define the second nanopore structures 401. It should be noted that, the second aluminum oxide bodies 410 of the second porous aluminum oxide film 4 are connected to corresponding ones of the first aluminum oxide bodies 310 of an adjacent one of the first porous aluminum oxide films 3, i.e., an $N^{th}$ first porous aluminum oxide film 3, along the first direction (X).

To be specific, in step (c), the second anodizing treatment is performed by applying a slowly increasing current signal, from 0 mA to a predetermined current value, to the aluminum-containing object 2 obtained after step (b) for a first predetermined time period, followed by applying another constant current signal having the predetermined current value to the aluminum-containing object 2 for a second predetermined time period. As shown in FIG. 5, the predetermined current value of the slowly increasing current signal is greater than a maximum current value (i.e., the first current value) of each of the N cycles of periodic current signals of the first anodizing treatment. In certain embodiments, in step (c), a current density of the slowly increasing current signal increases from 0 $mA/cm^2$ to 40 $mA/cm^2$ within a time period ranging from 100 seconds to 600 seconds.

As shown in FIG. 6, the second aluminum oxide film 4 is stacked between the $N^{th}$ first porous aluminum oxide film 3, among the N number of first porous aluminum oxide films 3, and the surface 211 of the aluminum-containing object 2 along the first direction (X). The second nanopore structures 401 in the second porous aluminum oxide film 4 are defined by corresponding ones of the second aluminum oxide bodies 410 in the second anodizing treatment of step (c) when slowly increasing current signal and the another constant current signal are applied to the aluminum-containing object 2 obtained after step (b). To be specific, the second nanopore structures 401 each has a cross-section of a tubular shape in the first direction (X), and includes an upper porous section 4011 (corresponding to application of the slowly increasing current signal for the first predetermined time period), and a lower porous section 4012 (corresponding to application of the another constant current signal for the second predetermined time period). The upper porous section 4011 is distal from the aluminum-containing object 2, widens at a top part, and is in spatial communication with the corresponding one of the first nanopore structures 301 of the $N^{th}$ first porous aluminum oxide film 3. The lower porous section 4012 is proximal to the aluminum-containing object 2, and is in spatial communication with the upper porous section 4011 and the surface 211 of the aluminum-containing object 2. The third porous sections 3013 of a corresponding one of the first nanopore structures 301 of the $N^{th}$ first porous aluminum oxide film 3 are in spatial communication with the upper pore section 4011 of a corresponding one of the second nanopore structures 401 of the second porous aluminum oxide film 4. A thickness of the second porous aluminum oxide film 4, which is measured from a top end to a bottom end along the first direction (X), is greater than a total thickness of the first porous aluminum oxide films 3.

It is worth to mention that, the method of the first embodiment utilizes the process parameters of the first anodizing treatment of step (b) to determine the base color exhibited by the anodic aluminum oxide-based photonic crystal product 1 obtained by the method through the first porous aluminum oxide films 3, and an interference generated after an external light source (not shown in figures) transmits to the first nanopore structures 301 of the corresponding ones of the first porous aluminum oxide films 3, enables the first porous aluminum oxide films 3 to exhibit different colors at different viewing angles. In addition, the method of the first embodiment also utilizes the process parameters of the second anodizing treatment of step (c) to adjust the interference generated after the external light source (not shown in figures) transmits to the second nanopore structures 401 of the second porous aluminum oxide film 4, so as to enhance color saturation and brightness of the anodic aluminum oxide-based photonic crystal product 1 obtained by the method of the first embodiment. In certain embodiments, the thickness of the second porous aluminum oxide film (4) is at least greater than or equal to 5 μm.

Figure 7:
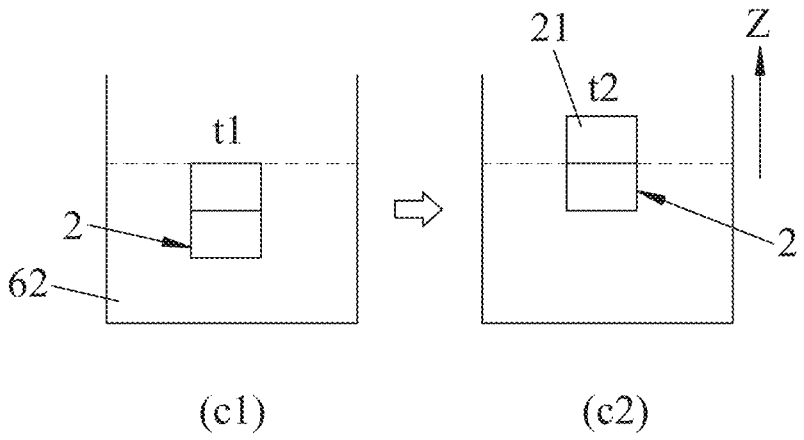
FIG. 7 is a schematic diagram of processes for preparing the anodic aluminum oxide-based photonic crystal product, illustrating sub-steps (c1) and (c2) of step (c) of the method for preparing the anodic aluminum oxide-based photonic crystal product according to a second embodiment of the present disclosure.
Figure 8:
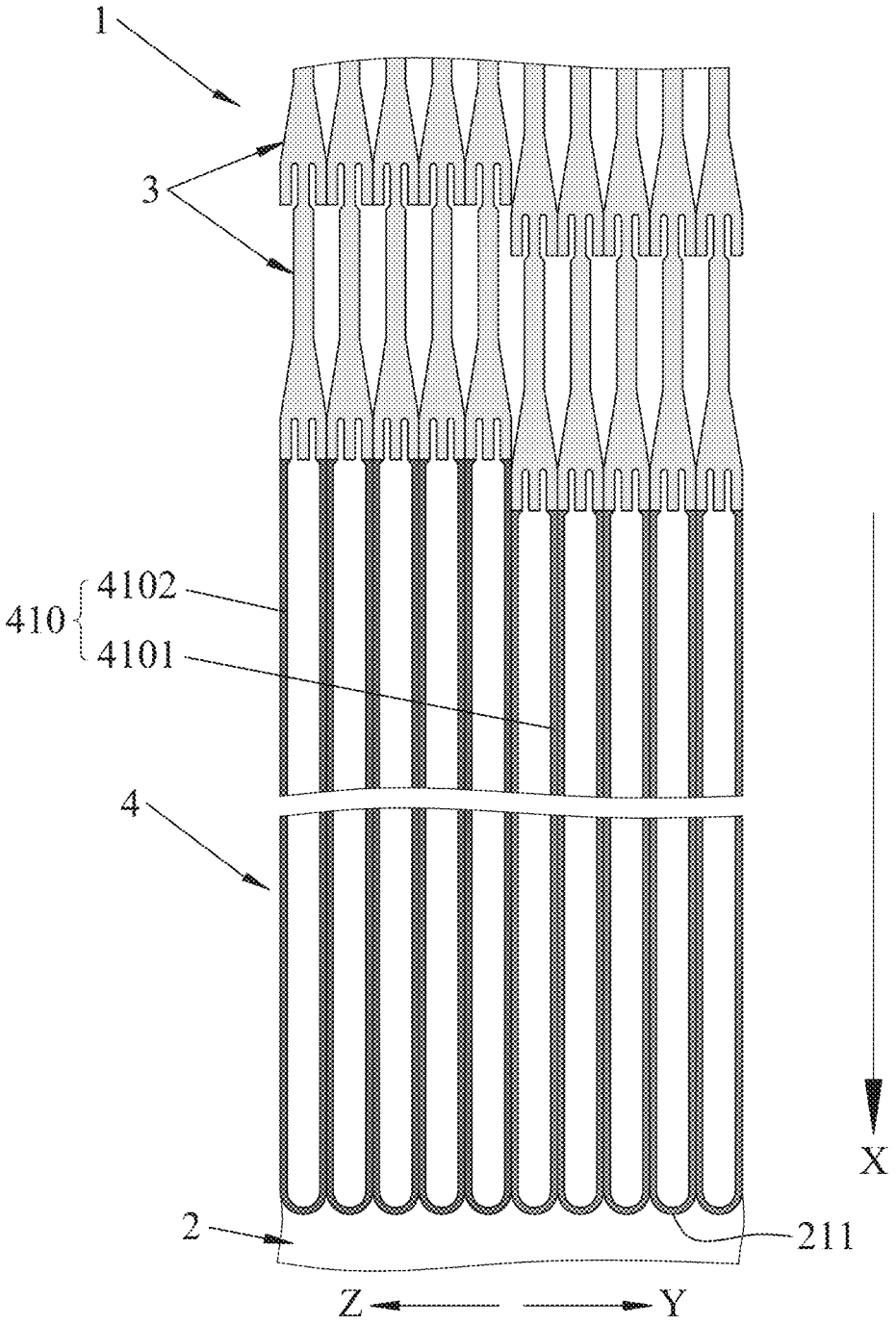
FIG. 8 is a fragmentary schematic view illustrating the anodic aluminum oxide-based photonic crystal product obtained after step (c) of the method according to the second embodiment of the present disclosure.

Referring to FIGS. 7 and 8, a method for preparing an anodic aluminum oxide-based photonic crystal product 1 according to a second embodiment of the present disclosure is substantially the same as the method of the first embodiment as described above, except that in the method of the second embodiment, step (c) further includes sub-steps (c1) and (c2).

In sub-step (c1), the second anodizing treatment is conducted by completely immersing the aluminum-containing object 2 obtained after step (b) in the second electrolyte solution 62 for a first reaction time period t1, such that the second porous aluminum oxide film 4 is formed on the surface 211 of the aluminum-containing object 2. The first reaction time period t1 in sub-step (c1) is greater than the first predetermined time period taken for the slowly increasing current signal to reach the predetermined current value in step (c).

In sub-step (c2), the aluminum-containing object 2 obtained after sub-step (c1) is driven to move upwards along a third direction (Z) that is away from the second electrolyte solution 62 (see the direction of the arrow in FIG. 7) using an automated lifting device (not shown in figures), such that a first portion 21 of the aluminum-containing object 2 is exposed from a top edge of the second electrolyte solution 62, while other portions of the aluminum-containing object 2 that remain immersed in the second electrolyte solution 62 are allowed to be continuously subjected to the second anodizing treatment for a second reaction time period, so that the second porous aluminum oxide film 4 is continuously formed and thickened on the surface 211 of the other portions of the aluminum-containing object 2 which remain immersed in the second electrolyte solution 62.

Referring to FIG. 8, after completing the aforesaid sub-step (c2) of the method of the second embodiment, the second aluminum oxide bodies 410 of the second porous aluminum oxide film 4 includes a first segment 4101 and a second segment 4102 which are sequentially arranged in parallel and connected to one another along a third direction (Z) that is opposite to the second direction (Y) and that is perpendicular to the first direction (X). Each of the first segment 4101 and the second segment 4102 has a thickness that is measured from a top end to a bottom end along the first direction (X), and the thickness of the second segment 4102 is greater than the thickness of the first segment 4101.

Figure 9:
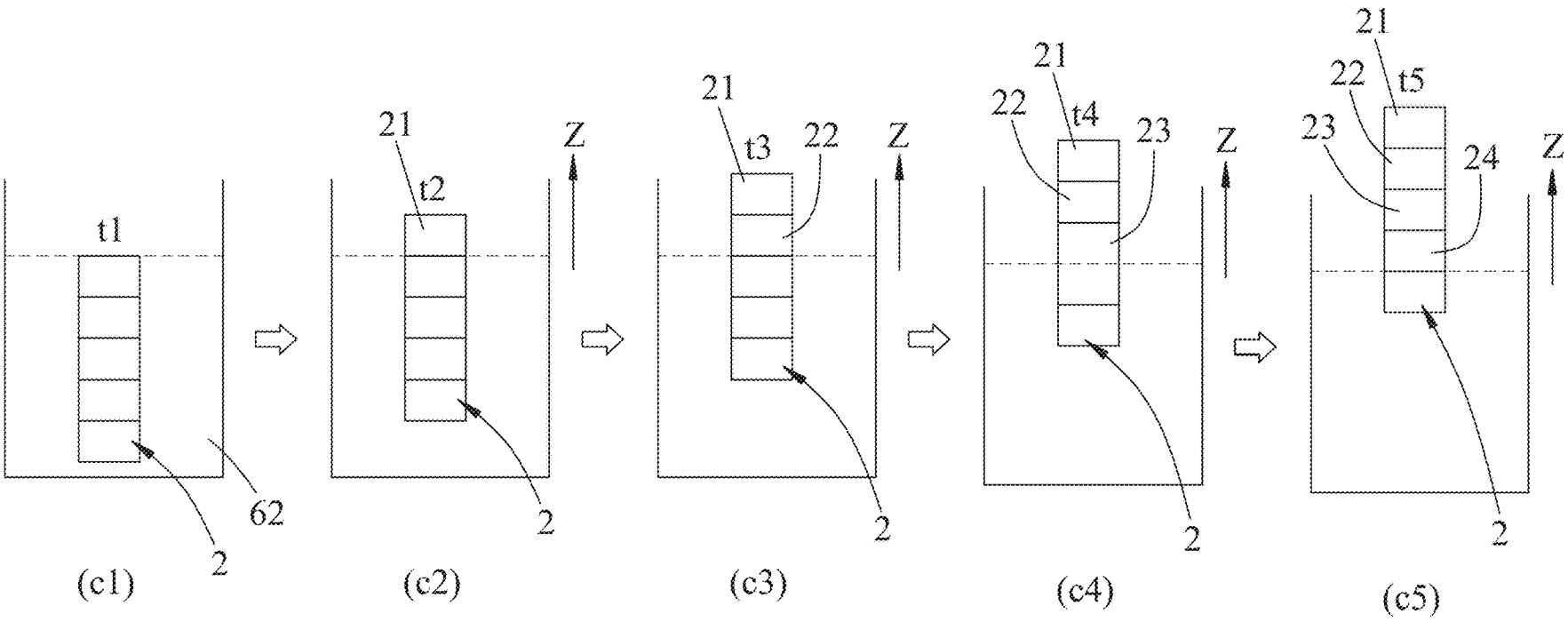
FIG. 9 a schematic diagram of processes for preparing the anodic aluminum oxide-based photonic crystal product, illustrating sub-steps (c3), (c4) and (c5) in addition to sub-steps (c1) and (c2) of step (c) of the method for preparing the anodic aluminum oxide-based photonic crystal product according to a third embodiment of the present disclosure.
Figure 10:
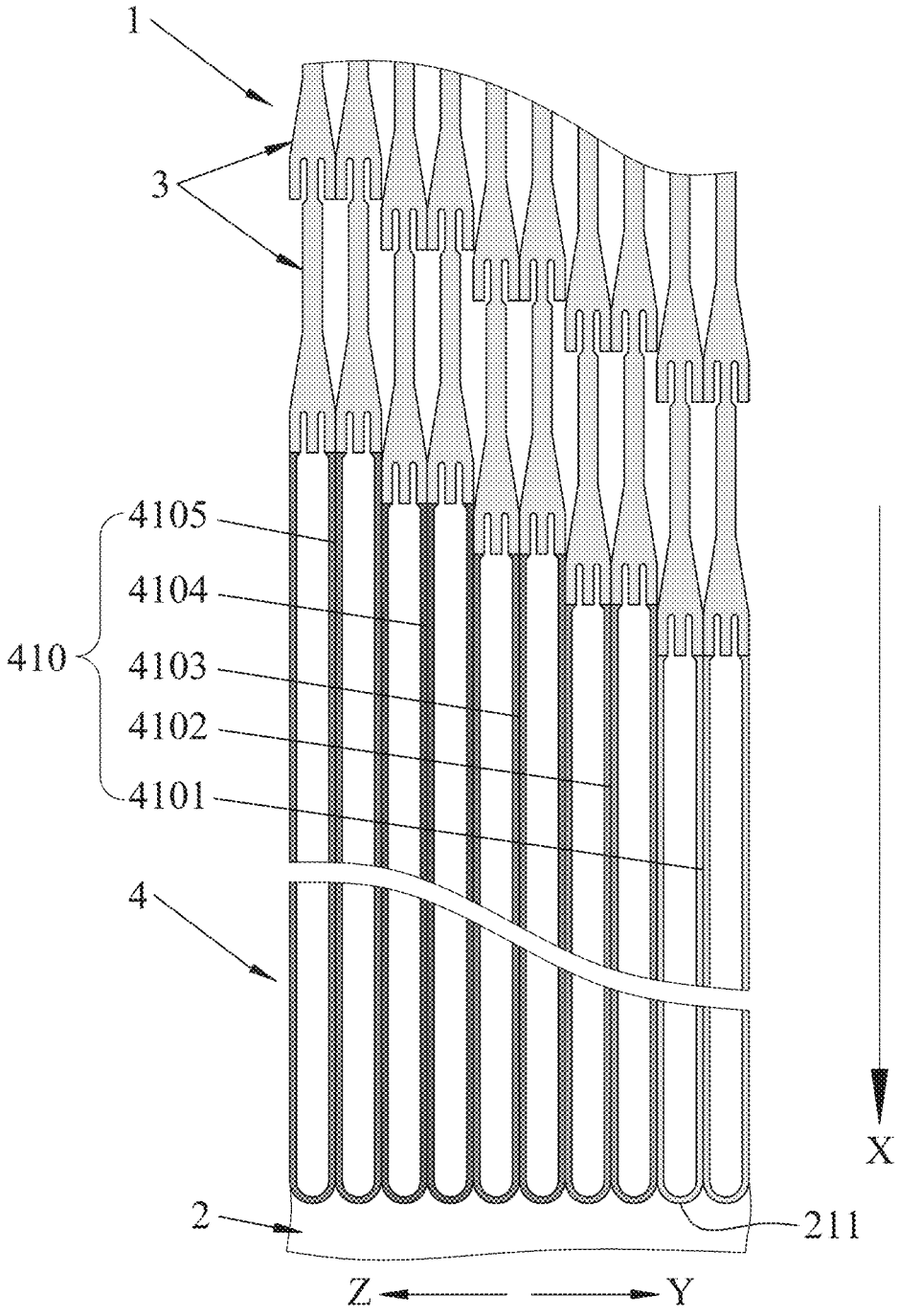
FIG. 10 is a fragmentary schematic view illustrating the anodic aluminum oxide-based photonic crystal product obtained after step (c) of the method according to the third embodiment of the present disclosure.

Referring to FIGS. 9 and 10, a method for preparing an anodic aluminum oxide-based photonic crystal product 1 according to a third embodiment of the present disclosure is substantially the same as the method of the second embodiment as described above, except that in the method of the third embodiment, step (c) further includes sub-steps (c3), (c4) and (c5).

In sub-step (c3), the aluminum-containing object 2 obtained after sub-step (c2) is driven to move upwards along the third direction (Z) that is away from the second electrolyte solution 62 using the automated lifting device, such that a second portion 22 of the aluminum-containing object 2, which is connected to the first portion 21 and the other portions which remain immersed in the second electrolyte solution 62, is exposed to from the top edge of the second electrolyte solution 62 together with the first portion 21, while the other portions of the aluminum-containing object 2 that remain immersed in the second electrolyte solution 62 are allowed to be continuously subjected to the second anodizing treatment for a third reaction time period, so that the second porous aluminum oxide film 4 is continuously formed and thickened on the surface 211 of the other portions of the aluminum-containing object 2 which remain immersed in the second electrolyte solution 62.

In sub-step (c4), the aluminum-containing object 2 obtained after sub-step (c3) is driven to move upwards along the third direction (Z) that is away from the second electrolyte solution 62, such that a third portion 23 of the aluminum-containing object 2, which is connected to the second portion 22 and the other portions which remain immersed in the second electrolyte solution 62, is exposed from the top edge of the second electrolyte solution 62 together with the first portion 21 and the second portion 22, while the other portions of the aluminum-containing object 2 that remain immersed in the second electrolyte solution 62 are allowed to be continuously subjected to the second anodizing treatment for a fourth reaction time period, so that the second porous aluminum oxide film 4 is continuously formed and thickened on the surface 211 of the other portions of the aluminum-containing object 2 which remain immersed in the second electrolyte solution 62.

In sub-step (c5), the aluminum-containing object 2 obtained after sub-step (c4) is driven to move upwards along the third direction (Z) that is away from the second electrolyte solution 62 using the automated lifting device, such that a fourth portion 24 of the aluminum-containing object 2, which is connected to the third portion 23 and the other portions which remain immersed in the second electrolyte solution 62, is exposed from the top edge of the second electrolyte solution 62 together with the first portion 21, the second portion 22 and the third portion 23, while the other portions of the aluminum-containing object 2 that remain immersed in the second electrolyte solution 62 are allowed to be continuously subjected to the second anodizing treatment for a fifth reaction time period, so that the second porous aluminum oxide film 4 is continuously formed and thickened on the surface 211 of other portions of the aluminum-containing object 2 which remain immersed in the second electrolyte solution 62.

Referring to FIG. 10, after completing the aforesaid sub-step (c5) of the method of the third embodiment, the second aluminum oxide bodies 410 of the second porous aluminum oxide film 4 further includes, in addition to the first segment 4101 and the second segment 4102, a third segment 4103, a fourth segment 4104 and a fifth segment 4105 which are sequentially arranged in parallel and connected to one another along the third direction (Z), and each of which has a thickness that is measured from a top end to a bottom end along the first direction (X). In the second porous aluminum oxide film 4, the third segment 4103 is connected to the second segment 4102, the thickness of the third segment 4103 is greater than the thickness of second segment 4102, the thickness of the fourth segment 4104 is greater than the thickness of the third segment 4103, and the thickness of the fifth segment 4015 is greater than the thickness of the fourth segment 4104.

A method for preparing an anodic aluminum oxide-based photonic crystal product 1 according to a fourth embodiment of the present disclosure is substantially the same as the method of the first embodiment as described above, except that in the method of the fourth embodiment, step (c) further includes sub-steps (c1) and (c2). In sub-step (c1), the second anodizing treatment is conducted by completely immersing the aluminum-containing object 2 obtained after step (b) in the second electrolyte solution 62 for a reaction time period, such that the second porous aluminum oxide film 4 is formed on the surface 211 of the aluminum-containing object 2. The reaction time period in sub-step (c1) is greater than the first predetermined time period taken for the slowly increasing current signal to reach the predetermined current value in step (c). In sub-step (c2), the aluminum-containing object 2 obtained after sub-step (c1) is driven to gradually move upwards along a third direction (Z) that is away from the second electrolyte solution 62 at a predetermined speed using the automated lifting device, such that the aluminum-containing object 2 is gradually exposed from the top edge of the second electrolyte solution 62, while portions of the aluminum-containing object 2 that remain immersed in the second electrolyte solution 62 are allowed to be continuously subjected to the second anodizing treatment, so that that the second porous aluminum oxide film 4 is continuously formed and thickened on the surface 211 of the portions of the aluminum-containing object 2 which remain immersed in the second electrolyte solution 62 until the aluminum-containing object 2 is completely removed from the second electrolyte solution 62.

As shown in FIG. 10, after completing the aforesaid sub-step (c2) of the method of the fourth embodiment, the thickness of the second porous aluminum oxide film 4 gradually increases, from the first segment 4101 to the fifth segment 4105, along the third direction (Z).

A method for preparing the anodic aluminum oxide-based photonic crystal product 1 according to other embodiments of the present disclosure includes steps (a), (b) and (c).

In step (a), the aluminum-containing object 2 is subjected to the first pretreatment, so as to remove contaminants on the surface 211 of the aluminum-containing object 2. In step (b), the aluminum-containing object 2 obtained after step (a) is subjected to the first anodizing treatment, in which cycles of the periodic current signals are applied to the aluminum-containing object 2, so as to form the first porous aluminum oxide films 3 that are sequentially stacked on the surface 211 of the aluminum-containing object 2. Each of the first porous aluminum oxide films 3 includes the first aluminum oxide bodies 310 which are arranged adjacent and parallel to one another and which are respectively connected to corresponding ones of the first aluminum oxide bodies 310 of two adjacent ones of the first porous aluminum oxide films 3, so as to define the first nanopore structures 301. In step (c), the aluminum-containing object 2 obtained after step (b) is subjected to the second anodizing treatment, so as to form the second porous aluminum oxide film 4 on the surface 211 of the aluminum-containing object 2 and beneath a bottommost one of the first porous aluminum oxide films 3 which is proximal to the aluminum-containing object 2 among the first porous aluminum oxide films 3. The second porous aluminum oxide film 4 includes the second aluminum oxide bodies 410 which are arranged adjacent and parallel to one another and which are connected to corresponding ones of the first aluminum oxide bodies 310 of the bottommost one of the first porous aluminum oxide films 3, so as to define the second nanopore structures 401. The second anodizing treatment is performed by applying the slowly increasing current signal, from 0 mA to a predetermined current value, to the aluminum-containing object 2 obtained after step (b) for the first predetermined time period, followed by maintaining application of the constant current signal having the predetermined current value to the aluminum-containing object 2 for the second predetermined time period. The predetermined current value is greater than a maximum current value of each of the cycles of periodic current signals of the first anodizing treatment.

An anodic aluminum oxide-based photonic crystal product 1 according to an embodiment of the present disclosure is prepared using the aforesaid method, and includes the aluminum-containing object 2, the N number of the first porous aluminum oxide films 3, and the second porous aluminum oxide film 4 as mentioned above. The details regarding the aluminum-containing object 2, the N number of the first porous aluminum oxide films 3, and the second porous aluminum oxide film 4 of the anodic aluminum oxide-based photonic crystal product 1 are similar to those described in the foregoing, and thus are not repeated herein for the sake of brevity.

The present disclosure will be described by way of the following examples. However, it should be understood that the following examples are intended solely for the purpose of illustration and should not be construed as limiting the present disclosure in practice.

Example 1 (E1)

All the procedures and conditions in a method for preparing an anodic aluminum oxide-based photonic crystal product of E1 were performed by utilizing a 6063 aluminum alloy plate which had a square shape, with a side length and a thickness of 40 mm and 6 mm, respectively.

First, the aluminum alloy plate was subjected to a first pretreatment. To be specific, the aluminum alloy plate was immersed in a first degreasing solution containing a first degreasing agent with a volume percentage concentration ranging from 1 vol % to 10 vol % at a temperature ranging from 40° C. to 70° C., and then subjected to ultrasonic oscillation cleaning for 1 minute to 10 minutes, followed by rinsing with purified water, blow drying, and drying in an oven at a temperature ranging from 75° C. to 100° C. for 20 minutes to 30 minutes conducted in sequence, so as to complete the degreasing of the first pretreatment. Next, the aluminum alloy plate obtained after the degreasing of the first pretreatment was subjected to, using aluminum oxide ($Al_2O_3$) balls having a diameter ranging from 40 μm to 500 μm, surface sandblasting at a pressure ranging from 1 kg/cm$^2$ to 5 kg/cm$^2$.

Thereafter, the aluminum alloy plate obtained after the surface sandblasting of the first pretreatment was subjected to a second pretreatment including degreasing, alkaline cleaning, pre-pickling, chemical polishing, and post-pickling conducted in sequence. To be specific, the aluminum alloy plate obtained after the surface sandblasting of the first pretreatment was immersed in a second degreasing solution containing a second degreasing agent with a volume percentage concentration ranging from 1 vol % to 10 vol % at a temperature ranging from 40° C. to 70° C., and then subjected to ultrasonic oscillation cleaning for 1 minute to 10 minutes, followed by rinsing with purified water, so as to complete the degreasing of the second pretreatment. Then, the aluminum alloy plate obtained after the degreasing of the second pretreatment was immersed in an alkaline solution containing sodium hydroxide (NaOH) with a weight percentage concentration ranging from 1 wt % to 10 wt % at a temperature ranging from 40° C. to 70° C. for 30 minutes to 120 minutes, followed by rinsing with purified water, so as to complete the alkaline cleaning of the second pretreatment. Afterwards, the aluminum alloy plate obtained after the alkaline cleaning of the second pretreatment was immersed in an acidic solution containing nitric acid ($HNO_3$) at a temperature ranging from 20° C. to 50° C. for 1 minute to 5 minutes, followed by rinsing with purified water, so as to complete the pre-pickling of the second pretreatment. In particular, the acidic solution was prepared by mixing nitric acid and deionized water in a volume ratio ranging from 1:9 to 5:5. Thereafter, the aluminum alloy plate obtained after the pre-pickling of the second pretreatment was immersed in an acidic solution containing phosphoric acid ($H_3PO_4$) with a weight percentage concentration ranging from 50 wt % to 85 wt % at a temperature ranging from 50° C. to 85° C. for 10 seconds to 300 seconds, followed by rinsing with purified water, so as to complete the chemical polishing of the second pretreatment. Afterwards, the aluminum alloy plate obtained after the chemical polishing of the second pretreatment was immersed in the acidic solution containing $HNO_3$ at a temperature ranging from 20° C. to 50° C. for 1 minute to 5 minutes, followed by rinsing with purified water, so as to complete the post-pickling of the second pretreatment.

Next, the aluminum alloy plate obtained after the post-pickling of the second pretreatment was subjected to a first anodizing treatment, in which such aluminum alloy plate served as a positive electrode, a lead plate served as a negative electrode, and a sulfuric acid solution with a concentration ranging from 0.5 M to 3.0 M served as a first electrolyte solution. To be specific, the aluminum alloy plate obtained after the post-pickling of the second pretreatment was immersed in the sulfuric acid solution at a temperature ranging from −5° C. to 10° C., and then 30 to 300 cycles of periodic current signals were applied, so as to form first porous aluminum oxide films in a number ranging from 30 to 300 on a surface of the aluminum alloy plate. Each of the first porous aluminum oxide films includes a plurality of first aluminum oxide bodies which are arranged adjacent and parallel to one another, so as to define a plurality of first nanopore structures.

In the method of E1 of the present disclosure, each cycle of the periodic current signals preferably has the following parameters: (i) a total time period ranging from 710 seconds to 900 seconds; (ii) a first current density J1, which ranged from 1 mA/cm$^2$ to 5 mA/cm$^2$, was applied during the first predetermined time period pt1, which ranged from 100 seconds to 150 seconds; (iii) a decreasing current having a current density deceleration rate J2, which ranged from 0.009 mA·cm$^{-2}$·−s$^{-1}$ to 0.09 mA·cm$^{-2}$·−s$^{-1}$, was applied during the second predetermined time period pt2, which ranged from 10 seconds to 100 seconds; and (iv) a second current density J3, which ranged from 0.1 mA/cm$^2$ to 0.5 mA/cm$^2$, was applied during the third predetermined time period pt3, which ranged from 600 seconds to 650 seconds.

Figure 11A:
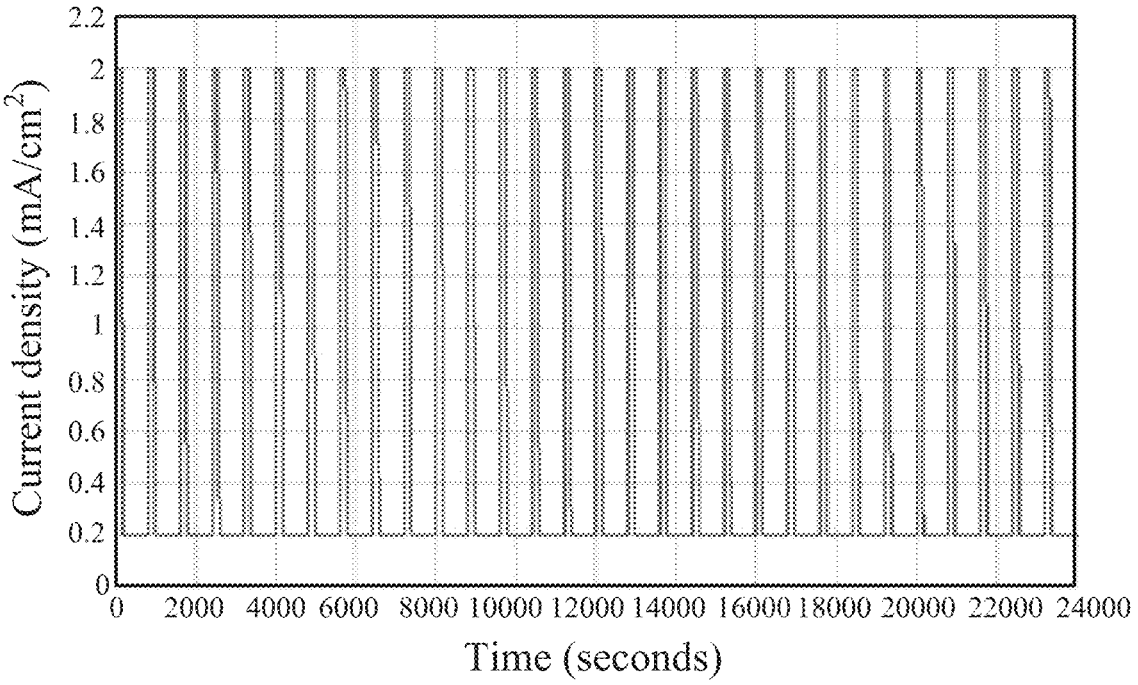
FIG. 11A is a graph of current density versus time illustrating application of periodic current signals in the first anodizing treatment of the method for preparing the anodic aluminum oxide-based photonic crystal product of Example 1 (E1).

The information regarding the specific parameters of the periodic current signals applied in the first anodizing treatment of E1 is summarized in Table 1 below with reference to FIG. 11A.

TABLE 1

| | |
|---|---|
| Total time period of each cycle of periodic current signals (seconds) | 800 |
| First current density J1 (mA/cm$^2$) | 2 |
| First predetermined time period pt1 (seconds) | 125 |
| Current density deceleration rate of decreasing current J2 (mA · cm$^{-2}$ · − s$^{-1}$) | 0.036 |
| Second predetermined time period pt2 (seconds | 50 |
| Second current density J3 (mA/cm$^2$) | 0.2 |
| Third predetermined time period pt3 (seconds) | 625 |
| Number of periodic current signals (cycles) | 30 |

Subsequently, the aluminum alloy plate obtained after the first anodizing treatment of E1 was fixedly placed on an automated lifting device (not shown in figures), and then subjected to a second anodizing treatment, in which such aluminum alloy plate served as a positive electrode, and the lead plate served as a negative electrode.

In the method of E1 of the present disclosure, the second anodizing treatment was preferably conducted by completely immersing the aluminum alloy plate obtained after the first anodizing treatment in a second electrolyte solution at a room temperature ranging from 20° C. to 30° C., and then applying a slowly increasing current, which had a current density of 0 mA/cm$^2$ to 20 mA/cm$^2$, to the aluminum alloy plate for a time period ranging from 100 seconds to 600 seconds, followed by applying a constant current having a current density of 20 mA/cm$^2$ for a time period of at least 900 seconds to 5400 seconds.

Figure 11B:
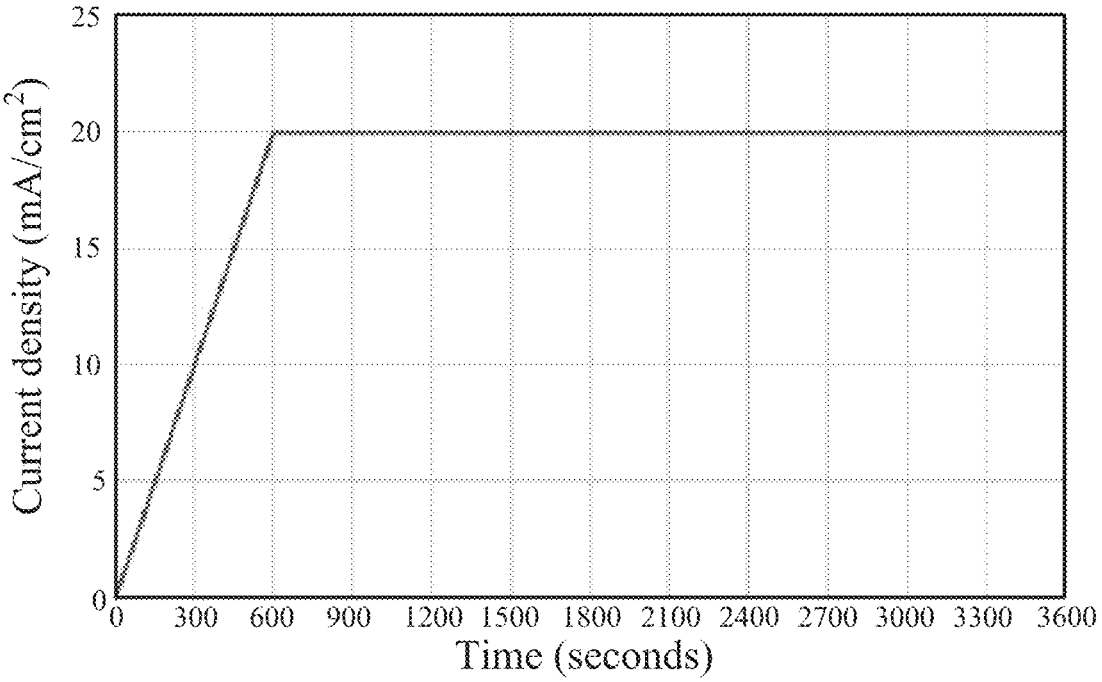
FIG. 11B is a graph of current density versus time illustrating application of periodic current signals in the second anodizing treatment of the method of E1.

It should be noted that, the second electrolyte solution used in E1 is a composite electrolyte that was prepared by mixing an inorganic acid and an organic acid. Examples of the inorganic acid may include, sulfuric acid, boric acid, and sulphamic acid. Examples of the organic acid may include, sulphosalicylic acid, hydroquinone, 1,5-napthalenedisulphonic acid, 4-sulphophthalic acid, succinic acid, oxalic acid, citric acid, tartaric acid, and formic acid. To be specific, the second electrolyte solution of E1 is made of an inorganic acid with a weight percentage concentration ranging from 0.1 wt % and 1.0 wt % and an organic acid with a weight percentage concentration ranging from 5 wt % to 20 wt %. As shown in FIG. 11B, in Example 1, the current density of the slowly increasing current increases from 0 mA/cm$^2$ to 20 mA/cm$^2$ within 600 seconds, and the constant current was applied at the current density of 20 mA/cm$^2$ for 3000 seconds.

Figure 12A:
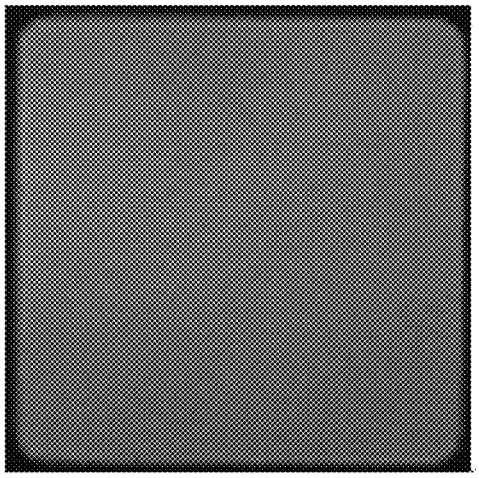
FIG. 12A is an image of the anodic aluminum oxide-based photonic crystal product obtained by the method of E1 which is taken from a top planar view at 0° angle.
Figure 12B:
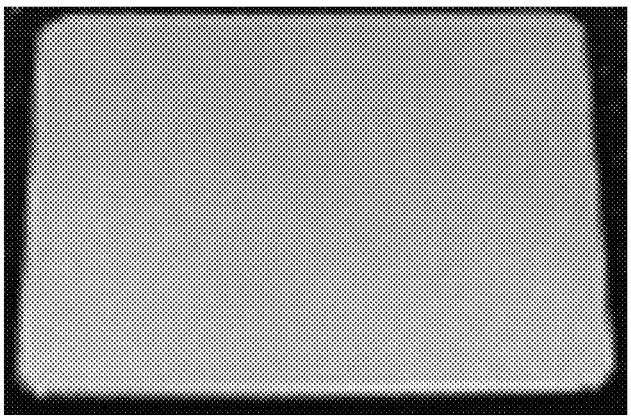
FIG. 12B is an image of the anodic aluminum oxide-based photonic crystal product obtained by the method of E1 which is taken from a tilted top planar view at 45° angle, showing that a color exhibited by the anodic aluminum oxide-based photonic crystal product of E1 at 45° angle is significantly different from a color exhibited by the same at 0° angle.

Referring to FIGS. 12A and 12B, after the second anodizing treatment, an anodic aluminum oxide-based photonic crystal product obtained by the method of E1 exhibited a distinct reddish color as seen from a top planar view thereof at 0° angle and exhibited a distinct yellowish-greenish color as seen from a tilted top planar view thereof at 45° angle. These results demonstrate that, by conducting the second anodizing treatment, the method of E1 of the present disclosure is capable of enhancing color saturation of the anodic aluminum oxide-based photonic crystal product obtained by such method, and thus brightness of the anodic aluminum oxide-based photonic crystal product is also expected to be enhanced.

Example 2 (E2)

The procedures and conditions in the method for preparing the anodic aluminum oxide-based photonic crystal product of E2 were substantially the same as those of E1, except for the detailed conditions of the first anodizing treatment.

In the method of E2 of the present disclosure, each cycle of the periodic current signals preferably has the following parameters: (i) a total time period ranging from 560 seconds to 750 seconds; (ii) a first current density J1, which ranged from 1 mA/cm$^2$ to 5 mA/cm$^2$, was applied during the first predetermined time period pt1, which ranged from 75 seconds to 125 seconds; (iii) a decreasing current having a current density deceleration rate J2, which ranged from 0.009 mA·cm$^{-2}$·−s$^{-1}$ to 0.09 mA·cm$^{-2}$·−s$^{-1}$, was applied during the second predetermined time period pt2, which ranged from 10 seconds to 100 seconds; and (iv) a second current density J3, which ranged from 0.1 mA/cm$^2$ to 0.5 mA/cm$^2$, was applied during the third predetermined time period pt3, which ranged from 475 seconds to 525 seconds.

Figure 13:
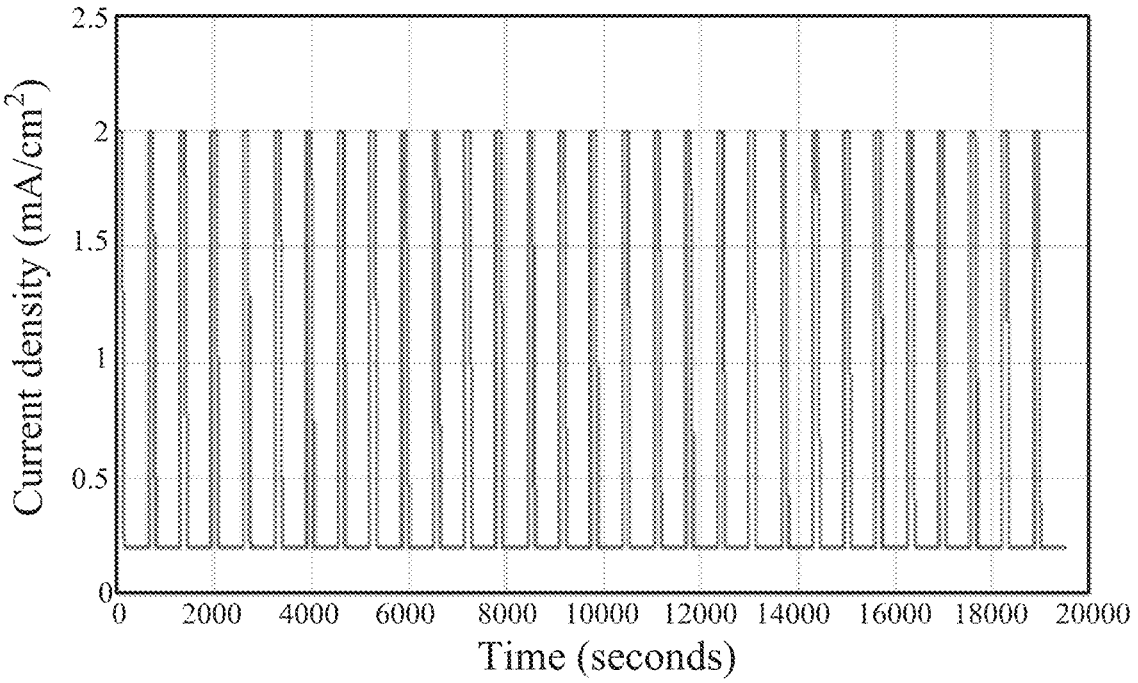
FIG. 13 is a graph of current density versus time illustrating application of periodic current signals in the first anodizing treatment of the method for preparing the anodic aluminum oxide-based photonic crystal product of Example 2 (E2).

The information regarding the specific parameters of the periodic current signals applied in the first anodizing treatment of E2 is summarized in Table 2 below with reference to FIG. 13.

TABLE 2

| | |
|---|---|
| Total time period of each cycle of periodic current signals (seconds) | 650 |
| First current density J1 (mA/cm$^2$) | 2 |
| First predetermined time period pt1 (seconds) | 100 |
| Current density deceleration rate of decreasing current J2 (mA · cm$^{-2}$ · − s$^{-1}$) | 0.036 |
| Second predetermined time period pt2 (seconds) | 50 |
| Second current density J3 (mA/cm$^2$) | 0.2 |
| Third predetermined time period pt3 (seconds) | 500 |
| Number of periodic current signals (cycles) | 30 |

Figure 14A:
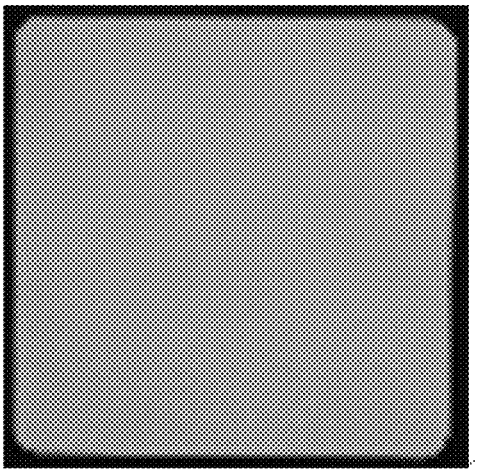
FIG. 14A is an image of the anodic aluminum oxide-based photonic crystal product obtained by the method of E2 which is taken from a top planar view at 0° angle.
Figure 14B:
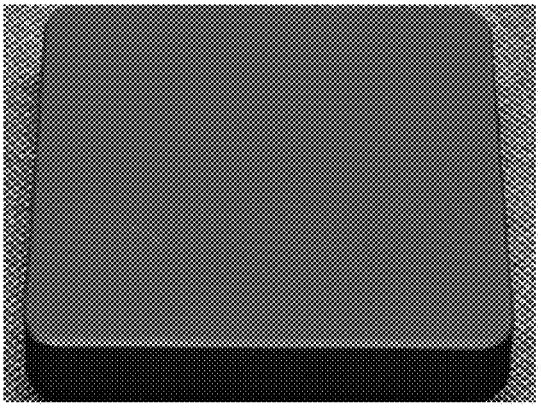
FIG. 14B is another image of the anodic aluminum oxide-based photonic crystal product obtained by the method of E2 which is taken from a tilted top planar view at 45° angle, showing that a color exhibited by the anodic aluminum oxide-based photonic crystal product of E2 at 45° angle is significantly different from a color exhibited by the same at 0° angle.

Referring to FIGS. 14A and 14B, after the first anodizing treatment and the second anodizing treatment, an anodic aluminum oxide-based photonic crystal product obtained by the method of E2 exhibited a distinct greenish color as seen from a top planar view thereof at 0° angle and exhibited a distinct bluish color at as seen from a tilted top planar view thereof at 45° angle. These results demonstrate that, since the process parameters of the first anodizing treatment in the method of E2 differ from those in the method of E1, the base color of the anodic aluminum oxide-based photonic crystal product obtained by the method of E2 (i.e., exhibiting the greenish color) differs from that of the anodic aluminum oxide-based photonic crystal product obtained by the method of E1 (i.e., exhibiting the reddish color), and since the anodic aluminum oxide-based photonic crystal product obtained by the method of E2 exhibited different colors under different viewing angles, by conducting the second anodizing treatment, the method of E2 is capable of enhancing the color saturation of the anodic aluminum oxide-based photonic crystal product obtained by such method, and thus the brightness of the anodic aluminum oxide-based photonic crystal product is also expected to be enhanced.

Example 3 (E3)

The procedures and conditions in the method for preparing the anodic aluminum oxide-based photonic crystal product of E3 were substantially the same as those of E2, except that in the method of E3, a 6063 aluminum alloy plate, which had a concentric ring shape, with an outer diameter, an inner diameter and a thickness of 30 mm, 2 mm and 1 mm, respectively, was utilized, and the second anodizing treatment was conducted in two stages. In a first stage, the aluminum alloy plate obtained after the first anodizing treatment was completely immersed in the second electrolyte solution using an automated lifting device (not shown in figures) for a first reaction time period t1 of 1800 seconds. In a second stage, the aluminum alloy plate was driven to move upwards and away from the second electrolyte solution by a distance of 15 mm using the automated lifting device, such that 15 mm of the aluminum alloy plate (i.e., an upper half of the aluminum alloy plate) was exposed from a top edge of the second electrolyte solution, while a lower half of the aluminum alloy plate continued to be immersed in the second electrolyte solution for a second reaction time period t2 of 900 seconds.

Figure 15:
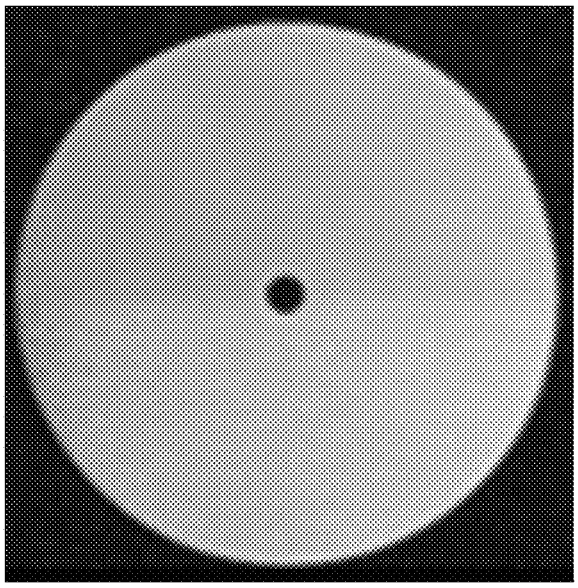
FIG. 15 is an image of the anodic aluminum oxide-based photonic crystal product obtained by the method of Example 3 (E3) which is taken from a top planar view at 0° angle.

Referring to FIG. 15, after the second anodizing treatment, an anodic aluminum oxide-based photonic crystal product obtained by the method of E3 exhibited two distinct colors, i.e., an upper half thereof exhibited a light greenish color while a lower half thereof exhibited a greenish color, as seen from a top planar view thereof at 0° angle. These results demonstrate that, by conducting the second anodizing treatment in two stages, i.e., the first stage and the second stage as described in the foregoing, the method of E3 not only can enhance the color saturation and brightness of the anodic aluminum oxide-based photonic crystal product obtained by such method, but also enables the anodic aluminum oxide-based photonic crystal product to exhibit two distinct colors. It should be noted that, the second anodizing treatment conducted in two stages in the method of E3 may replace the wet etching process disclosed by the method of CN 103243368 A, and the method of E3 not only enhances the color saturation and brightness of the anodic aluminum oxide-based photonic crystal product obtained thereby, but also omits use of the etchant disclosed by the method of CN 103243368 A.

Example 4 (E4)

The procedures and conditions in the method for preparing the anodic aluminum oxide-based photonic crystal product of E4 were substantially the same as those of E1 and E3, i.e., the 6063 aluminum alloy plate of the method of E3 was utilized, and the process parameters of the first anodizing treatment were the same as those of E1, except that in the method of E4, the second anodizing treatment was conducted in five stages, in which one-fifth of the aluminum alloy plate, from top to bottom based to thickness thereof, was exposed from the top edge of the second electrolyte solution in each of the five stages. To be specific, in the second anodizing treatment, a first stage was conducted for first reaction time period t1 of 900 seconds and the aluminum alloy plate was completely immersed in the second electrolyte solution, a second stage was conducted for a second reaction time period t2 of 900 seconds and 6 mm of the aluminum alloy plate was exposed from the top edge of the second electrolyte solution, a third stage was conducted for a third reaction time period t3 of 900 seconds and 12 mm of the aluminum alloy plate was exposed from the top edge of the second electrolyte solution, a fourth stage was conducted for a fourth reaction time period t4 of 900 seconds and 18 mm of the aluminum alloy plate was exposed from the top edge of the second electrolyte solution, and a fifth stage was conducted for a fifth reaction time period t5 of 900 seconds and 24 mm of the aluminum alloy plate was exposed from the top edge of the second electrolyte solution.

Figure 16:
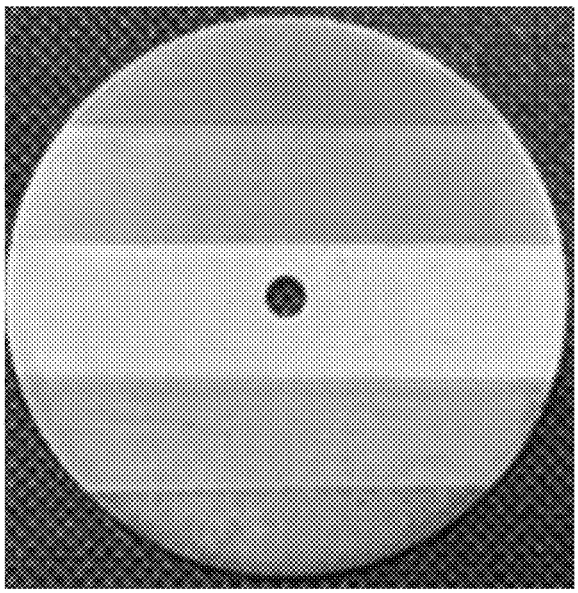
FIG. 16 is an image of the anodic aluminum oxide-based photonic crystal product obtained by the method of Example 4 (E4) which is taken from a top planar view at 0° angle.

Referring to FIG. 16, by conducting the second anodizing treatment in five stages as described in the foregoing, an anodic aluminum oxide-based photonic crystal product obtained by the method of E4 exhibited five distinct colors, i.e., reddish, orangish, yellowish, greenish and bluish colors from top to bottom thereof, as seen from a top planar view thereof at 0° angle.

Example 5 (E5)

The procedures and conditions in the method for preparing the anodic aluminum oxide-based photonic crystal product of E5 were substantially the same as those of E4, except that in the method of E5, the second anodizing treatment was conducted by gradually removing the aluminum alloy plate from the second electrolyte solution at a predetermined speed. To be specific, first, the aluminum alloy plate obtained after the first anodizing treatment was completely immersed in the second electrolyte solution using the automated lifting device for a reaction time period of 900 seconds, and then the aluminum alloy plate was driven to move upwards and away from the second electrolyte solution using the automated lifting device at the predetermined speed of 0.1 mm/seconds, such that the aluminum alloy plate was gradually exposed from the top edge of the second electrolyte solution while portions of the same remained immersed in the second electrolyte solution to be continuously subjected to the second anodizing treatment until the aluminum alloy plate was completely removed from the second electrolyte solution. It should be noted that, the aluminum alloy plate obtained after the second anodizing treatment was subjected to screen printing, so that a coating layer having a pattern as shown in FIGS. 17A and 17B, was formed on a topmost one of the first porous aluminum oxide films.

Figure 17A:
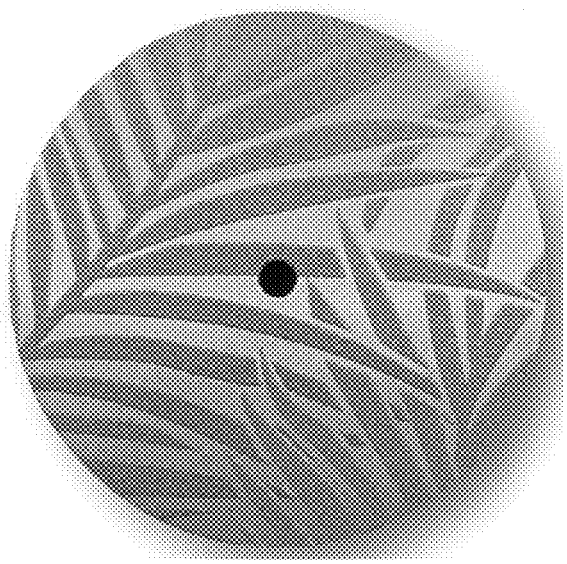
FIG. 17A is an image of the anodic aluminum oxide-based photonic crystal product obtained by the method of Example 5 (E5) which is taken from a top planar view at 0° angle.
Figure 17B:
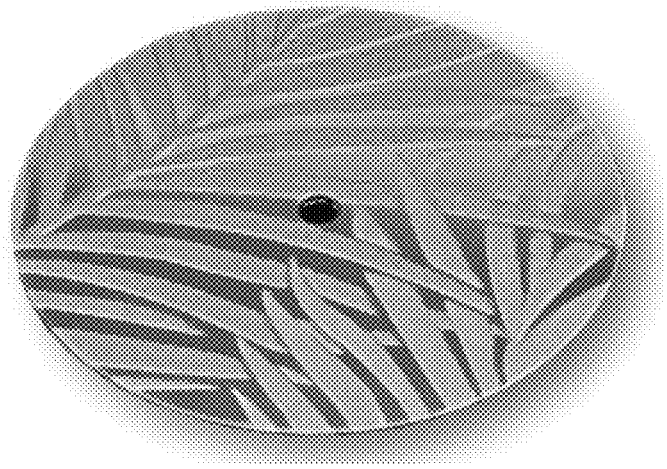
FIG. 17B is another image of the anodic aluminum oxide-based photonic crystal product obtained by the method of E5 which is taken from a tilted top planar view at 45° angle, showing that a color exhibited by the anodic aluminum oxide-based photonic crystal product of E5 at 45° angle is significantly different from a color exhibited by the same at 0° angle.

As shown in FIG. 17A, by gradually removing the aluminum alloy plate from the second electrolyte solution at a predetermined speed in the second anodizing treatment, an anodic aluminum oxide-based photonic crystal product obtained by the method of E5 exhibited a five-color gradient of reddish, orangish, yellowish, greenish and bluish colors from top to bottom, as seen from a top planar view thereof at 0° angle. As shown in FIG. 17B, the anodic aluminum oxide-based photonic crystal product obtained by the method of E5 exhibited a bluish-greenish color gradient as seen from a tilted top planar view thereof at 45° angle.

Figure 18:
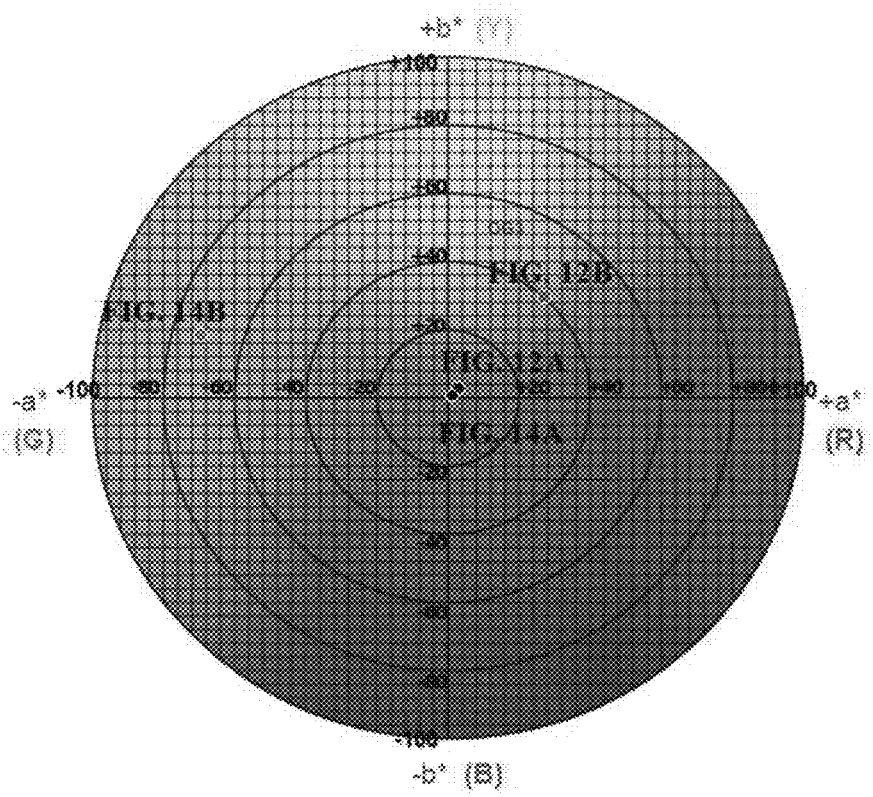
FIG. 18 shows distribution of color saturation in a CIELAB color space diagram of the International Commission on Illumination for the anodic aluminum oxide-based photonic crystal products respectively obtained by the methods of E1 and E2.

FIG. 18 shows distribution of color saturations of the anodic aluminum oxide-based photonic crystal products respectively obtained by the methods of E1 and E2 in a CIELAB color space diagram of the International Commission on Illumination. The CIE coordinate values of the aluminum alloy plates obtained after the respective first anodizing treatment in the methods of E1 and E2, respectively, as marked by the words "FIG. 12A" and "FIG. 14A" respectively in FIG. 18, were proximal to the center point of the CIELAB color space diagram, indicating that the color saturation of such aluminum alloy plates was relatively low. In contrast, CIE coordinate values of the anodic aluminum oxide-based photonic crystal products obtained after the respective second anodizing treatment in the methods of E1 and E2, respectively, as marked by the words "FIG. 12B" and "FIG. 14B" respectively in FIG. 18, were distal from the center point of the CIELAB color space diagram, indicating that the color saturation of such anodic aluminum oxide-based photonic crystal products had been greatly enhanced.

Based on the aforesaid description, by applying the decreasing current signal for the second predetermined time period pt2 of the respective one of the N cycles of periodic current signals in the first anodizing treatment of method of present disclosure, the middle portion of each of the first aluminum oxide bodies 310 of the respective one of the first aluminum oxide films 3 has two opposite inclined sides, such that the middle side portions of the two adjacent ones of the first aluminum oxide bodies 310 define the second porous section 3012 of each of the first nanopore structures 301, thereby allowing the anodic aluminum oxide-based photonic crystal 1 prepared by the method of the present disclosure, through the first porous aluminum oxide films 3, to exhibit different colors at different viewing angles. In addition, by conducting the second anodizing treatment after the first anodizing treatment, the color saturation and the brightness of the anodic aluminum oxide-based photonic crystal product 1 prepared by the method of the present disclosure can also be enhanced.

In summary, by virtue of the method for preparing the anodic aluminum oxide-based photonic crystal product 1 of the present disclosure, the anodic aluminum oxide-based photonic crystal product 1 obtained from the method of the present disclosure not only exhibits different colors at different viewing angles, but also has enhanced color saturation and brightness. Therefore, the purpose of the present disclosure can indeed be achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An anodic aluminum oxide-based photonic crystal product, comprising:

an aluminum-containing object;

an N number of first porous aluminum oxide films that are sequentially stacked on a surface of the aluminum-containing object along a first direction, the first direction being defined as a direction from a topmost one of the first porous aluminum oxide films, which is distal from the aluminum-containing object, to a bottommost one of the first porous aluminum oxide films, which is proximal to the aluminum-containing object, each of the first porous aluminum oxide films including a plurality of first nanopore structures which extend along the first direction and which are spaced apart from one another along a second direction that is perpendicular to the first direction; and a second porous aluminum oxide film formed on the surface of the aluminum-containing object and beneath an $N^{th}$ first porous aluminum oxide film among the N number of first porous aluminum oxide films in the first direction, the second porous aluminum oxide film including a plurality of second nanopore structures which extend along the first direction and which are spaced apart from one another along the second direction, wherein each of the plurality of second nanopore structures has a cross-section of a tubular shape in the first direction, and includes an upper porous section and a lower porous section, the upper porous section being is distal from the aluminum-containing object, widens at a top part, and being in spatial communication with a corresponding one of the plurality of the first nanopore structures of the $N^{th}$ first porous aluminum oxide film, the lower porous section being proximal to the aluminum-containing object and being in spatial communication with the upper porous section and the surface of the aluminum-containing object, wherein a thickness of the second porous aluminum oxide film, which is measured from a top end to a bottom end along the first direction, is greater than a total thickness of the plurality of the first porous aluminum oxide films, and wherein the thickness of the second porous aluminum oxide film gradually increases along a third direction that is opposite to the second direction and that is perpendicular to the first direction.

2. The anodic aluminum oxide-based photonic crystal product as claimed in claim 1, wherein each of the first porous aluminum oxide films further includes a plurality of first aluminum oxide bodies which are arranged adjacent and parallel to one another along the second direction, so as to define the plurality of first nanopore structures.

3. The anodic aluminum oxide-based photonic crystal product as claimed in claim 2, wherein the second porous aluminum oxide film further includes a plurality of second aluminum oxide bodies which are arranged adjacent and parallel to one another along the second direction, so as to define the plurality of second nanopore structures.

4. The anodic aluminum oxide-based photonic crystal product as claimed in claim 1, wherein the thickness of the second porous aluminum oxide film is at least greater than or equal to 5 μm.

5. The anodic aluminum oxide-based photonic crystal product as claimed in claim 4, wherein each of the plurality of first nanopore structures includes a first porous section, a second porous section, a plurality of third porous sections, and a fourth porous section along the first direction, the first porous section of each of the first nanopore structures is defined by upper side portions of two adjacent ones of the plurality of first aluminum oxide bodies and has a cross-section of a rectangular shape along the first direction, the second porous section of each of the first nanopore structures is defined by middle side portions of the two adjacent ones of the plurality of first aluminum oxide bodies, gradually tapers downwardly to form a pointed end such that the second porous section has a cross-section of an inverted triangular shape along the first direction, and is in spatial communication with the first porous section, the plurality of third porous section of each of the first nanopore structures are each defined by a lower portion of a corresponding one of the plurality of first aluminum oxide bodies, are spaced apart from one another along the second direction, each extends downwardly to have a cross-section of a tubular shape along the first direction, have a size smaller than a size of the first porous section, and are not in spatial communication with the second porous section, the fourth porous section of each of the first nanopore structures is defined by bottom side end portions of the two adjacent ones of the plurality of first aluminum oxide bodies, rapidly widens at a top part along the first direction, and is in spatial communication with corresponding ones of the plurality of third porous section, for the each of the first nanopore structures of a respective one of the first porous aluminum oxide films, the first porous section is in spatial communication with the fourth porous section of an adjacent one of the first nanopore structures of a corresponding adjacent one of the first porous aluminum oxide films that is distal to the aluminum-containing object along the first direction, and the fourth porous section is in spatial communication with the first porous section of another adjacent one of the first nanopore structures of a corresponding adjacent one of the first porous aluminum oxide films that is proximal to the aluminum-containing object along the first direction, in each of the first nanopore structures of the $N^{th}$ first porous aluminum oxide film, the fourth porous section is absent, and the third porous section is in spatial communication with an upper pore section of a corresponding one of the second nanopore structure of the second porous aluminum oxide film.

6. The anodic aluminum oxide-based photonic crystal product as claimed in claim 3, wherein the plurality of second aluminum oxide bodies of the second porous aluminum oxide film include a first segment and a second segment which are sequentially arranged in parallel and connected to one another along a third direction that is opposite to the second direction and that is perpendicular to the first direction, each of the first segment and the second segment has a thickness that is measured from a top end to a bottom end along the first direction, and the thickness of the second segment is greater than the thickness of the first segment.

7. The anodic aluminum oxide-based photonic crystal product as claimed in claim 6, wherein the plurality of second aluminum oxide bodies of the second porous aluminum oxide film further includes a third segment, a fourth segment and a fifth segment which are sequentially arranged in parallel and connected to one another along the third direction, and each of which has a thickness that is measured from a top end to a bottom end along the first direction, the third segment is connected to the second segment, the thickness of the third segment is greater than the thickness of second segment, the thickness of the fourth segment is greater than the thickness of the third segment, and the thickness of the fifth segment is greater than the thickness of the fourth segment.

* * * * *